US011609522B2

(12) United States Patent
Hirose et al.

(10) Patent No.: US 11,609,522 B2
(45) Date of Patent: Mar. 21, 2023

(54) IMAGE FORMING SYSTEM, CONTROL METHOD, AND STORAGE MEDIUM

(71) Applicant: CANON KABUSHIKI KAISHA, Tokyo (JP)

(72) Inventors: Fumiaki Hirose, Saitama (JP); Ryo Degawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/583,875

(22) Filed: Jan. 25, 2022

(65) Prior Publication Data

US 2022/0236681 A1 Jul. 28, 2022

(30) Foreign Application Priority Data

| | | |
|---|---|---|
| Jan. 27, 2021 | (JP) | JP2021-011287 |
| Jan. 27, 2021 | (JP) | JP2021-011288 |
| Feb. 18, 2021 | (JP) | JP2021-024689 |
| Oct. 13, 2021 | (JP) | JP2021-168002 |

(51) Int. Cl.
*G03G 15/00* (2006.01)

(52) U.S. Cl.
CPC ..... *G03G 15/5062* (2013.01); *G03G 15/5041* (2013.01)

(58) Field of Classification Search
CPC ..... G03G 15/2064; G03G 15/234; G03G 15/5041; G03G 15/5058; G03G 15/5062
See application file for complete search history.

(56) References Cited

U.S. PATENT DOCUMENTS 6,243,545 B1 * 6/2001 Jewell ..... G03G 15/2064 399/45
6,941,083 B1 * 9/2005 Muratani ..... G03G 15/235 399/49

FOREIGN PATENT DOCUMENTS

| | | |
|---|---|---|
| JP | 2011013468 A | 1/2011 |
| JP | 2017019201 A | 1/2017 |
| JP | 2018112714 A | 7/2018 |

* cited by examiner

*Primary Examiner* — Hoang X Ngo
(74) *Attorney, Agent, or Firm* — Canon U.S.A., Inc. IP Division

(57) ABSTRACT

An image forming system cyclically conveys an Nth sheet with an image formed on a first side to an image forming unit as a sheet subject to image formation after image formation on a subsequent (N+i)th sheet, and form an image on a second side of the Nth sheet. The system includes an obtaining unit that, during image forming processes, obtains respective updated adjustment values for the first and second sides, and a control unit that performs control to simultaneously store the updated adjustment value for the first side and an unupdated adjustment value for the second side in a part of a period of the processes, form an image on the first side of the (N+i)th sheet using the updated one for the first side, and form the image on the second side of the Nth sheet using the unupdated one for the second side.

16 Claims, 18 Drawing Sheets

FIG.3A

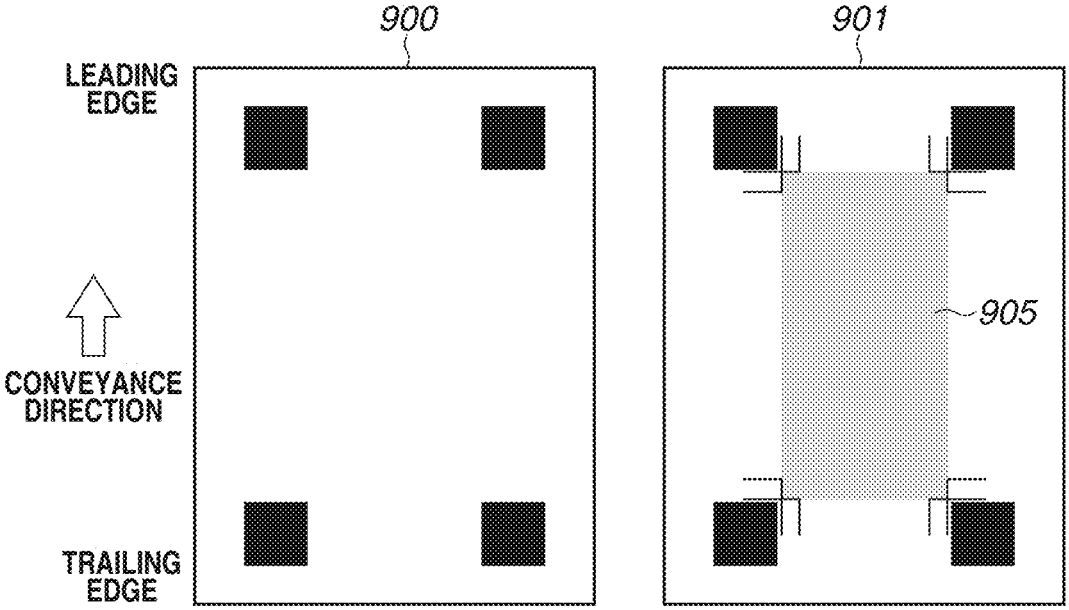

FIG.3B

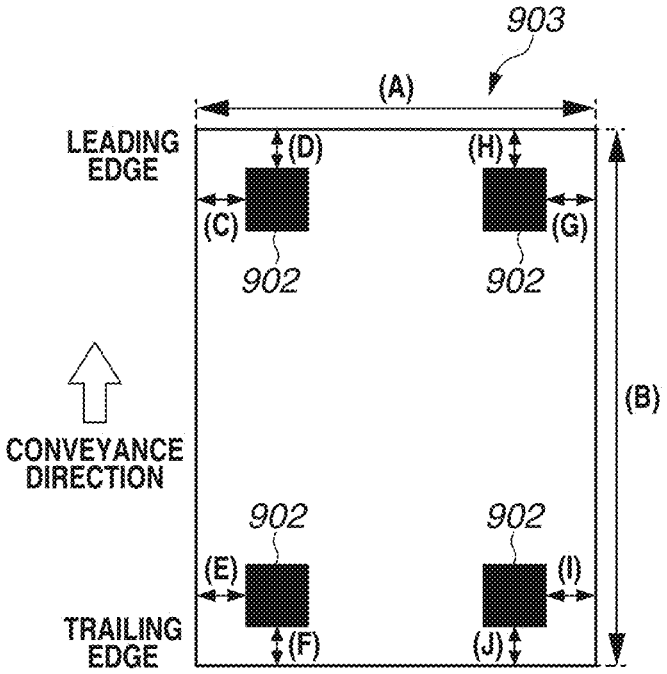

FIG.3C

| ADJUSTMENT VALUE ID | 2 |
|---|---|
| FRONT/BACK | FRONT |
| (A) MAIN SCANNING DIRECTION SHEET SIZE | 2973 |
| (B) SUB SCANNING DIRECTION SHEET SIZE | 4201 |
| (C) TOP LEFT MARKER END (MAIN SCANNING DIRECTION) | 99 |
| (D) TOP LEFT MARKER END (SUB SCANNING DIRECTION) | 99 |
| (E) BOTTOM LEFT MARKER END (MAIN SCANNING DIRECTION) | 100 |
| (F) BOTTOM LEFT MARKER END (SUB SCANNING DIRECTION) | 101 |
| (G) TOP RIGHT MARKER END (MAIN SCANNING DIRECTION) | 100 |
| (H) TOP RIGHT MARKER END (SUB SCANNING DIRECTION) | 101 |
| (I) BOTTOM RIGHT MARKER END (MAIN SCANNING DIRECTION) | 101 |
| (J) BOTTOM RIGHT MARKER END (SUB SCANNING DIRECTION) | 100 |

UNIT: 0.1 mm

FIG.4A

910

| | MEASUREMENT VALUE (911) | IDEAL VALUE (912) | ADJUSTMENT VALUE (913) |
|---|---|---|---|
| LEADING EDGE WRITE POSITION (914) | ((D)+(H))/2 | 10 mm | MEASUREMENT VALUE - IDEAL VALUE |
| LEFT EDGE WRITE POSITION (915) | ((C)+(E))/2 | 10 mm | MEASUREMENT VALUE - IDEAL VALUE |
| MAIN SCANNING MAGNIFICATION (916) | (((A)-(C)-(G))+((A)-(E)-(I)))/2 | MAIN SCANNING DIRECTION SHEET LENGTH - 20 mm | (MEASUREMENT VALUE - IDEAL VALUE)/IDEAL VALUE |
| SUB SCANNING MAGNIFICATION (917) | (((B)-(D)-(F))+((B)-(H)-(J)))/2 | SUB SCANNING DIRECTION SHEET LENGTH - 20 mm | (MEASUREMENT VALUE - IDEAL VALUE)/IDEAL VALUE |

FIG.4B

920

| | | FIRST SET OF ADJUSTMENT VALUES (921) | SECOND SET OF ADJUSTMENT VALUES (922) |
|---|---|---|---|
| | ADJUSTMENT VALUE ID | 1 | 2 |
| 923 | MAIN SCANNING DIRECTION WRITE POSITION (FRONT SIDE) | +3 (pix) | +1 (pix) |
| 923 | SUB SCANNING DIRECTION WRITE POSITION (FRONT SIDE) | +2 (pix) | -1 (pix) |
| 923 | MAIN SCANNING MAGNIFICATION (FRONT SIDE) | -0.01 (%) | +0.02 (%) |
| 923 | SUB SCANNING MAGNIFICATION (FRONT SIDE) | -0.01 (%) | +0.01 (%) |
| 924 | MAIN SCANNING DIRECTION WRITE POSITION (BACK SIDE) | -1 (pix) | +1 (pix) |
| 924 | SUB SCANNING DIRECTION WRITE POSITION (BACK SIDE) | +1 (pix) | -1 (pix) |
| 924 | MAIN SCANNING MAGNIFICATION (BACK SIDE) | +0.01 (%) | -0.01 (%) |
| 924 | SUB SCANNING MAGNIFICATION (BACK SIDE) | +0.01 (%) | +0.02 (%) |

FIG.5

500

| SHEET NUMBER | ADJUSTMENT VALUE ID |
|---|---|
| 1 | 1 |
| 2 | 1 |
| 3 | 1 |
| 4 | 1 |
| ... | ... |
| 21 | 1 |
| 22 | 2 |
| 23 | 2 |
| 24 | 2 |
| 25 | 2 |

FIG.14

2500

| SHEET NUMBER | ADJUSTMENT VALUE ID |
|---|---|
| 1 | 1 |
| 2 | 1 |
| 3 | 1 |
| 4 | 1 |
| 5 | 1 |
| 6 | 1 |
| 7 | 1 |
| 8 | 2 |
| 9 | 2 |
| 10 | 2 |
| 11 | - |

IMAGE FORMING SYSTEM, CONTROL METHOD, AND STORAGE MEDIUM

BACKGROUND

Field of the Disclosure

The present disclosure relates to an image forming system that reads an image adjustment pattern formed on a sheet by using a reading apparatus located at a subsequent stage of a conveyance path and makes image adjustments based on the read image.

Description of the Related Art

There is known a printing system in which a reading apparatus is connected to a subsequent stage of an image forming apparatus for forming an image on a sheet and the image formed on the sheet by the image forming apparatus is read by the reading apparatus. Japanese Patent Application Laid-Open No. 2017-19201 discusses a technique that reads a chart in the middle of a series of image forming processes and makes adjustments for the subsequent image forming processes. With such a configuration, details of the adjustments are updated each time image adjustment timing occurs.

A typical image forming system first forms an image on the front side of a fed sheet using an image forming unit, reverses the sheet in a conveyance path to convey the sheet to the image forming unit again, and then forms an image on the back side to output the sheet. Thus, in a case where duplex printing is continuously performed, the image formation on the front side precedes the image formation on the back side depending on the length of the conveyance path of the image forming apparatus. Suppose, as discussed in Japanese Patent Application Laid-Open No. 2017-19201, that adjustment values are updated at fixed timing and the updated adjustment values are applied to the image formation on the front side and the image formation on the back side. In such a case, there may be a situation where the adjustment values before the update are applied to the front side where the image formation is performed at earlier timing, whereas the adjustment values after the update are applied to the back side where the image formation is performed at later timing. A product in which the adjustment values updated at different timings are respectively applied to the front side and the back side may give a sense of incongruity to the customer. It is therefore desirable that the adjustment values updated at the same timing should be applied to both the front side and the back side.

SUMMARY

The present disclosure is directed to providing an image forming system capable of forming appropriately adjusted images on the first side and the second side of a sheet.

According to an aspect of the present disclosure, an image forming system configured to cyclically convey an Nth sheet with an image formed on a first side by an image forming unit to the image forming unit as a sheet to be subjected to image formation after image formation on an (N+i)th sheet subsequent to the Nth sheet, and form an image on a second side of the Nth sheet includes one or more controllers configured to function as an obtaining unit configured to, during a series of image forming processes for image formation on a plurality of sheets including the Nth sheet and the (N+i)th sheet, obtain an updated adjustment value for the first side and an updated adjustment value for the second side as adjustment values to be used for image formation, and a control unit configured to control an image processing unit to perform processing so that the updated adjustment value for the first side and an unupdated adjustment value for the second side are simultaneously stored in a storage in a part of a period of the series of image forming processes, form an image on the first side of the (N+i)th sheet by using the updated adjustment value for the first side, and then form the image on the second side of the Nth sheet by using the unupdated adjustment value for the second side.

Further features of the present disclosure will become apparent from the following description of exemplary embodiments with reference to the attached drawings.

BRIEF DESCRIPTION OF THE DRAWINGS

FIG. 3A is a diagram illustrating sheets on which an adjustment chart is formed according to one or more aspects of the present disclosure. FIG. 3B is a diagram illustrating the adjustment chart according to one or more aspects of the present disclosure. FIG. 3C is a diagram illustrating examples of dimensions in the adjustment chart according to one or more aspects of the present disclosure.

FIG. 4A is a diagram illustrating an adjustment value calculation method according to one or more aspects of the present disclosure. FIG. 4B is a diagram illustrating examples of sets of adjustment values before and after update according to one or more aspects of the present disclosure.

FIG. 5 is a diagram illustrating a table for managing sheets and adjustment value identifiers (IDs) according to one or more aspects of the present disclosure.

FIG. 14 is a diagram illustrating a table for managing sheets and adjustment value IDs according to one or more aspects of the present disclosure.

DESCRIPTION OF THE EMBODIMENTS

Exemplary embodiments of the present disclosure will be described concretely with reference to the drawings.

<Image Forming System>

Figure 2A:
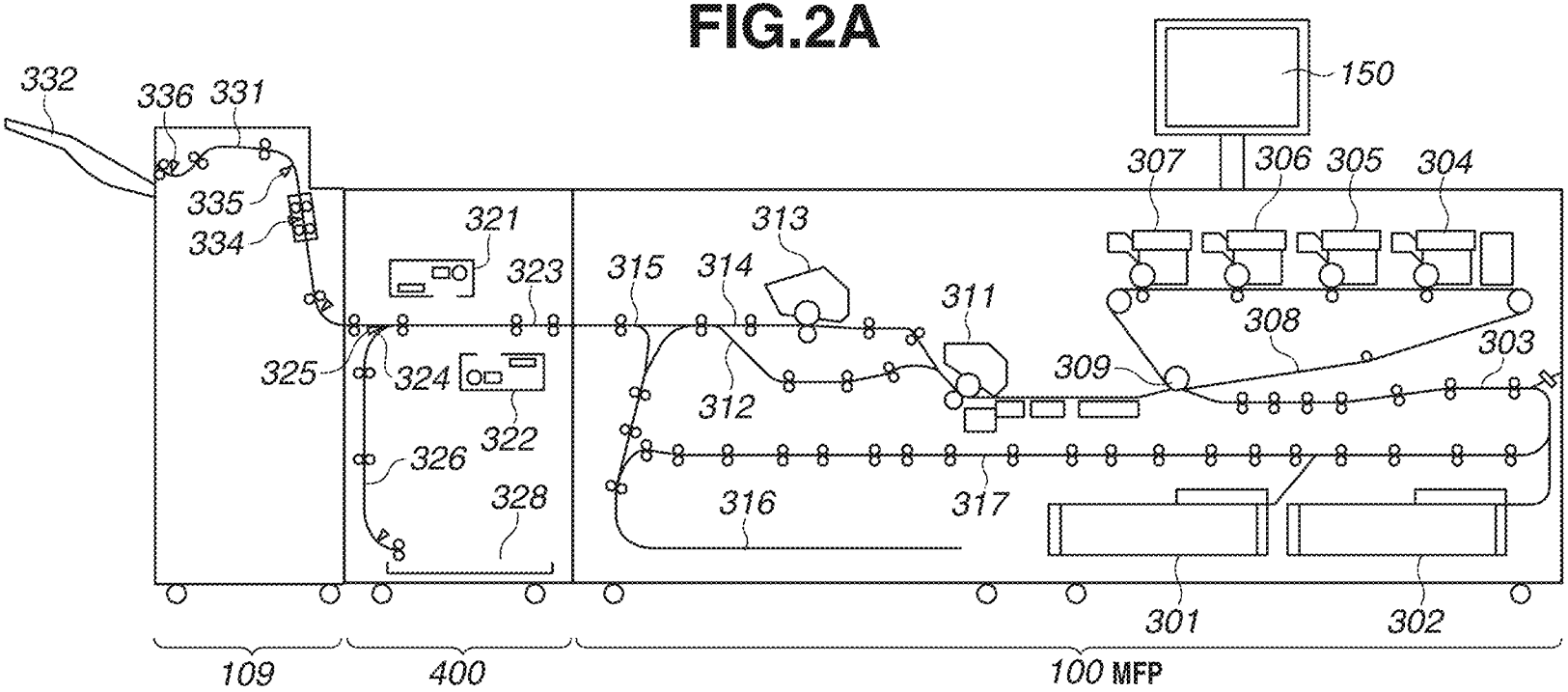
FIG. 2A is a sectional diagram illustrating a mechanical configuration of the MFP, the reading apparatus, and a finisher according to one or more aspects of the present disclosure.

FIG. 2A is a sectional diagram illustrating a mechanical configuration of an image forming system according to a first exemplary embodiment of the present disclosure. As illustrated in FIG. 2A, the image forming system includes a multifunction peripheral (MFP) 100, a reading apparatus 400, and a finisher 109 that are connected together. The MFP 100 is an image forming apparatus that forms an image on a sheet. The MFP 100 may use an electrophotographic method, an inkjet method, or any other image forming method. In the present exemplary embodiment, the MFP 100 will be described as an electrophotographic image forming apparatus. The reading apparatus 400 is an optional apparatus that reads an image from a sheet (a document) on which the image is formed. The reading apparatus 400 is connectable to a subsequent stage of the MFP 100.

The finisher 109 is a postprocessing apparatus that applies post processing to a sheet on which an image is formed. The image forming system conveys a sheet to the MFP 100, the reading apparatus 400, and the finisher 109 in this order, and outputs the sheet on which an image is formed as a product. A series of image forming processes will be described next.

The MFP 100 includes sheet feed decks 301 and 302 that can store various types of sheets. Each of the sheet decks 301 and 302 can separate the uppermost sheet from the stored sheets and convey the sheet to a sheet conveyance path 303. To form a color image, development stations 304 to 307 form toner images using toner of yellow (Y), magenta (M), cyan (C), and black (K) colors, respectively. The formed toner images are primarily transferred onto an intermediate transfer belt 308, and conveyed to a secondary transfer position 309 by the intermediate transfer belt 308 rotating clockwise. The toner images are then transferred onto the sheet conveyed from the sheet conveyance path 303.

A fixing unit 311 is configured to fix the toner images to the sheet. The fixing unit 311 includes a pressure roller and a heating roller. Passing the sheet between the rollers melts and pressurizes the toner, whereby the toner images are fixed to the sheet. The sheet having passed through the fixing unit 311 is conveyed to a sheet conveyance path 315 through a sheet conveyance path 312. Depending on the sheet type, additional melting and pressurization may be applied for fixing. In such a case, the sheet having passed through the fixing unit 311 is conveyed to a second fixing unit 313 through an upper sheet conveyance path. After the application of the additional melting and pressurization, the sheet is conveyed to the sheet conveyance path 315 through a sheet conveyance path 314. If the image formation mode is a duplex mode, the sheet is conveyed to a sheet reversing path 316, and then reversed and conveyed to a duplex conveyance path 317, so that image transfer onto a second side of the sheet is performed at the secondary transfer position 309. At this time, image formation on the second side of the Nth sheet is performed in such order that the Nth sheet is arranged behind another (N+i)th sheet that has followed the Nth sheet in the image formation on the first side of the Nth sheet. Such sheet conveyance will be referred to as cyclic conveyance.

Figure 18:
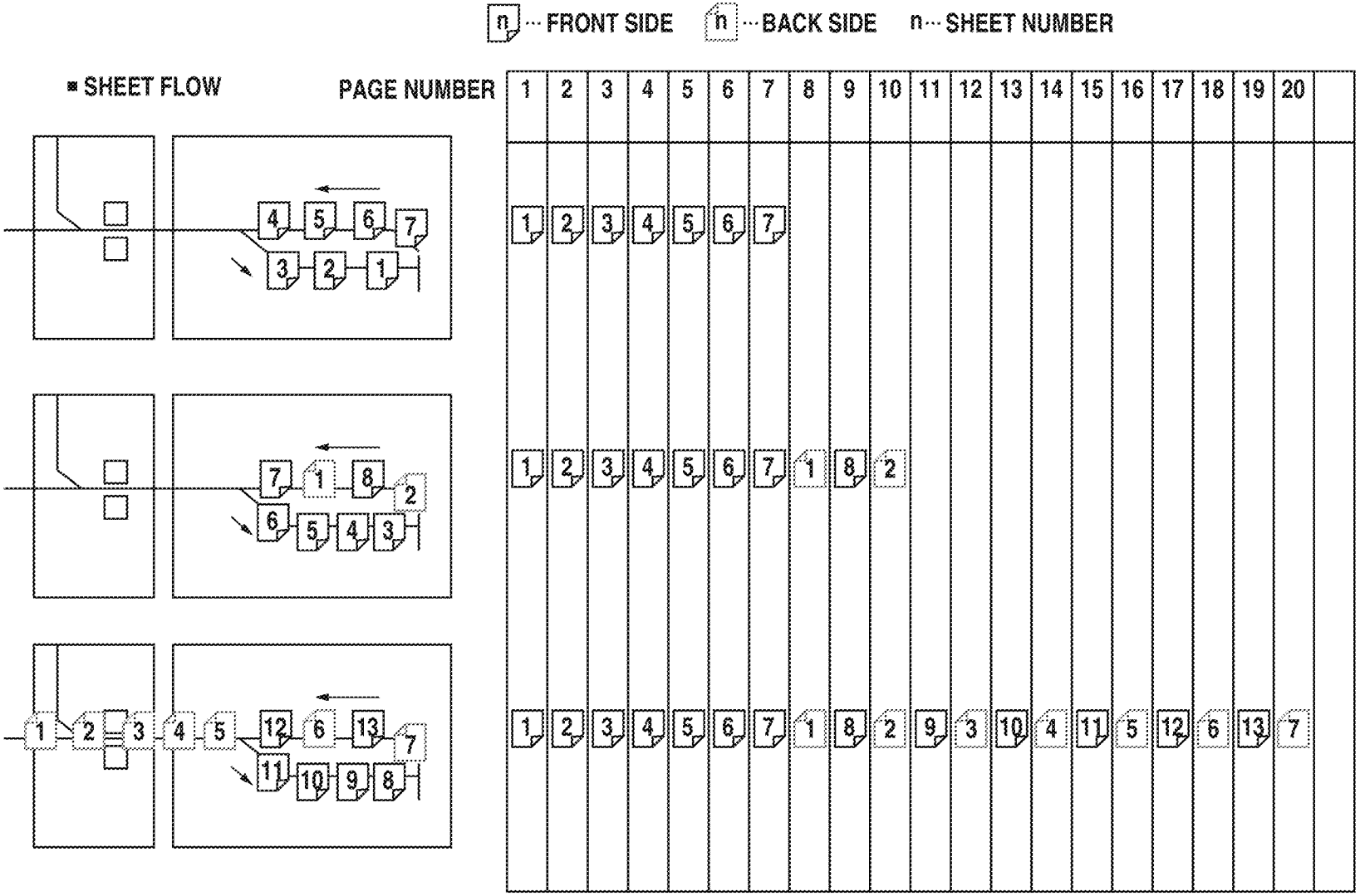
FIG. 18 is a diagram illustrating cyclic conveyance according to one or more aspects of the present disclosure.

FIG. 18 illustrates flow of sheets in the cyclic conveyance. FIG. 18 illustrates the progress of the cyclic conveyance in three phases. In this example, sheet numbers indicate the order of sheets supplied for image formation. Page numbers indicate the order in which the image formation is to be performed. A common sheet number is used for the front side and the back side of a sheet. A different page number is used for each of the front side and the back side of a sheet.

In the state illustrated in the upper part of FIG. 18, the sheets with the sheet numbers 1 to 7 are present in the MFP 100.

In this phase, the image formation is performed on the front side and is not performed on the back side. Thus, the sheet numbers and the page numbers correspond to each other.

In the state illustrated in the middle part of FIG. 18, the sheets with the sheet numbers 1 to 8 are present in the MFP 100.

At this time, the back side of the sheet with the sheet number 1 is processed as the page number 8, and the back side of the sheet with the sheet number 2 is processed as the page number 10. In other words, the image formation for the page numbers 8, 9, and 10 is performed in order of the back side, the front side, and the back side. As described above, in the cyclic conveyance, the image formation on the front side and the image formation on the back side are performed in a mixed manner.

In the state illustrated in the lower part of FIG. 18, the sheets with the sheet numbers 4 to 13 are present in the MFP 100. The sheets with the sheet numbers 1, 2, and 3 where the image formation is completed on both the front side and the back side are sequentially conveyed to the reading apparatus 400.

Each of the sheets conveyed to the reading apparatus 400 is conveyed on a sheet conveyance path 323 and passes reading positions of an upper surface reading unit 321 (a contact image sensor (CIS) unit for the front side) and a lower surface reading unit 322 (a CIS unit for the back side). The upper surface reading unit 321 includes a light-emitting diode (LED) 350, a reading sensor 351, and a white reference plate 352. The lower surface reading unit 322 includes an LED 353, a reading sensor 354, and a white reference plate 355. If the conveyed sheet is an image adjustment chart sheet on which an image adjustment pattern is printed (see a chart 900 in FIG. 3A to be described below), a flapper 324 is switched to a direction of conveying the sheet to a discharge path 326. The sheet (the output product or the print product) conveyed to the discharge path 326 is discharged to a discharge tray 328. If the sheet conveyed to the sheet conveyance path 323 is a sheet with a user's print image (see a chart 901 in FIG. 3A to be described below), the flapper 324 is switched to a direction of conveying the sheet to a downstream conveyance path 325. The sheet conveyed to the downstream conveyance path 325 is conveyed to the finisher 109. If notification of occurrence of a conveyance jam is provided by the finisher 109, the flapper 324 is switched to the direction of conveying the sheet to the discharge path 326 to discharge the sheet to the discharge tray 328 regardless of whether the sheet is an image adjustment chart sheet. Discharging all the remaining sheets to the discharge tray 328 can reduce the user's load of jam handling. The finisher 109 is a sheet discharge unit capable of stacking a large amount of sheets. The finisher 109 includes a stack tray 332 as a tray for stacking sheets. The sheet conveyed from the reading apparatus 400 passes through a sheet conveyance path 331 and is stacked on the stack tray 332. The finisher 109 detects the passage of the sheet using conveyance sensors 334, 335, and 336. If the leading edge or trailing edge of the sheet does not reach the conveyance sensor 334, 335, or 336 after a lapse of a predetermined time, the finisher 109 determines that a conveyance jam has occurred therein, and notifies the MFP 100 of the occurrence of the conveyance jam.

<MFP>

Figure 1A:
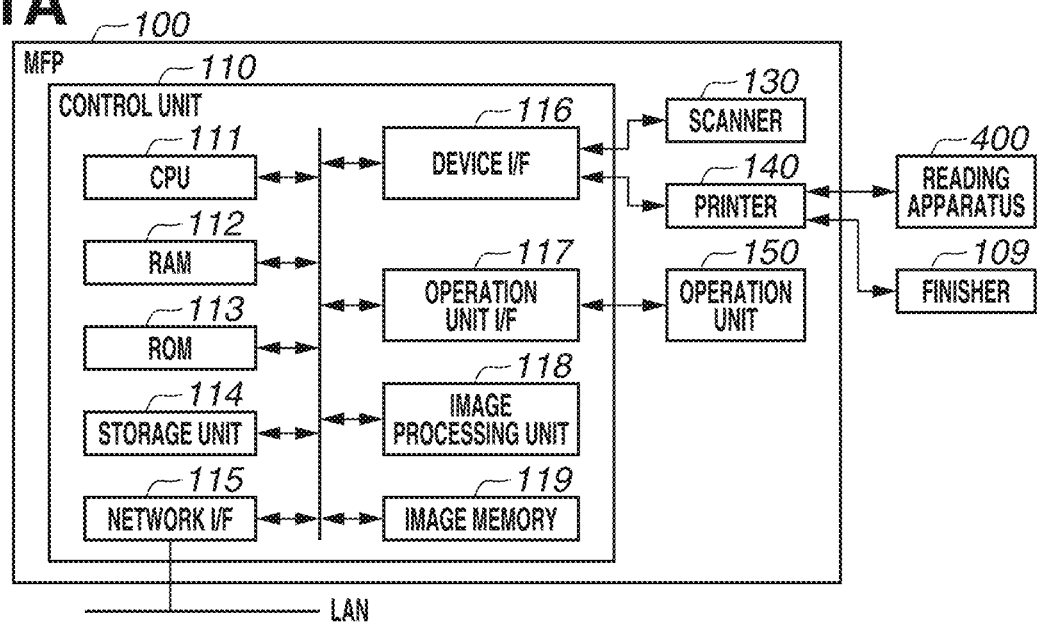
FIG. 1A is a block diagram illustrating a system configuration of a multifunction peripheral (MFP) according to one or more aspects of the present disclosure.

A configuration of the MFP 100 will be described next. FIG. 1A is a system block diagram of the MFP 100 used as an image forming apparatus. As illustrated in FIG. 1A, the MFP 100 includes a control unit 110, a scanner 130, a printer 140, and an operation unit 150.

The scanner 130 is a reading unit that reads an image from a document. The scanner 130 may be of automatic document feeder (ADF) type or pressure plate type, or may use both of these.

The printer 140 is an image forming unit that forms an image on a sheet.

The operation unit 150 is an operation panel that presents information to the user and receives an input from the user. The operation unit 150 includes a display serving as a display unit for displaying information, and hardware keys serving as a reception unit for receiving an information input. The operation unit 150 may include a touch panel capable of inputting and outputting information.

The control unit 110 is a controller that controls the MFP 100 in a centralized manner. The control unit 110 is connected to the scanner 130 serving as an image input device and the printer 140 serving as an image output device, and controls input and output of image information. Meanwhile, the control unit 110 is connected to a local area network (LAN), and receives a print job via the LAN. The control unit 110 includes a central processing unit (CPU) 111, a random access memory (RAM) 112, a read-only memory (ROM) 113, a storage unit 114, a network interface (I/F) 115, a device I/F 116, an operation unit O/F 117, an image processing unit 118, and an image memory 119.

The CPU 11 controls the operation of the MFP 100, and operates based on programs stored in the RAM 112. The ROM 113 is a boot ROM and stores a boot program of the image forming system. The storage unit 114 stores system software, image data, and programs for controlling the operation of the MFP 100. A hard disk drive (HDD) or a solid state drive (SSD) is used as the storage unit 114. The CPU 111 controls the operation of the MFP 110 based on the programs stored in the storage unit 114 and loaded into the RAM 112. The network I/F 115 is connected to the LAN and controls input and output of various types of information via the network. The device I/F 116 connects the scanner 130 and the printer 140, which serve as the image input and output devices, to the control unit 110, and converts image data between synchronous and asynchronous systems. The printer 140 is also connectable to various accessories including the finisher 109 and the reading apparatus 400.

The operation unit I/F 117 connects the operation unit 150 and the control unit 110, and outputs, to the operation unit 150, the image data to be displayed on the operation unit 150. The operation unit I/F 117 also transmits the information input by the user on the operation unit 150 to the CPU 111. The image processing unit 118 is a processor that performs image processing on print data received via the LAN.

The image processing unit 118 also performs image processing on image data to be input from and output to the device I/F 116. The image memory 119 is a memory for temporarily loading the image data to be processed by image processing unit 118.

Figure 1B:
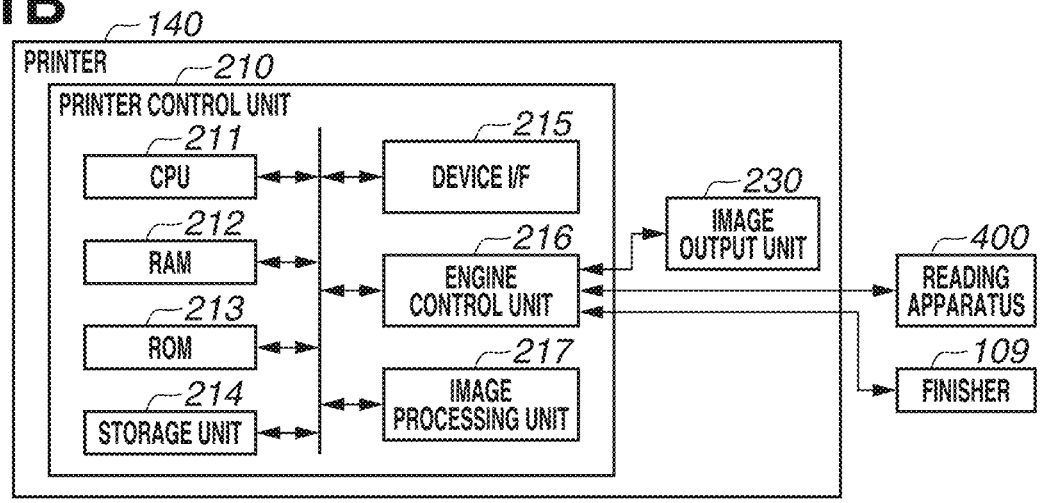
FIG. 1B is a block diagram illustrating a system configuration of a printer according to one or more aspects of the present disclosure.

FIG. 1B is a block diagram of the printer 140. The printer 140 serves as an image forming unit for forming an image on a sheet, and includes a printer control unit 210 and an image output unit 230.

The printer control unit 210 includes a CPU 211, a RAM 212, a ROM 213, a storage unit 214, a device I/F 215, an engine control unit 216, and an image processing unit 217. The CPU 211 controls the operation of the printer 140, and operates based on programs stored in the ROM 213 and loaded into the RAM 212. The storage unit 214 stores information for storing information to be used in control by the printer control unit 210, and programs for controlling the operation of the printer 140. The device I/F 215 is connected to the control unit 110 and converts image data between synchronous and asynchronous systems. The engine control unit 216 controls the components of a printer engine and the connected accessories, including the image output unit 230, the finisher 109, and the reading apparatus 400. The image processing unit 217 processes image data to be output to the image output unit 230.

<Reading Apparatus>

Figure 1C:
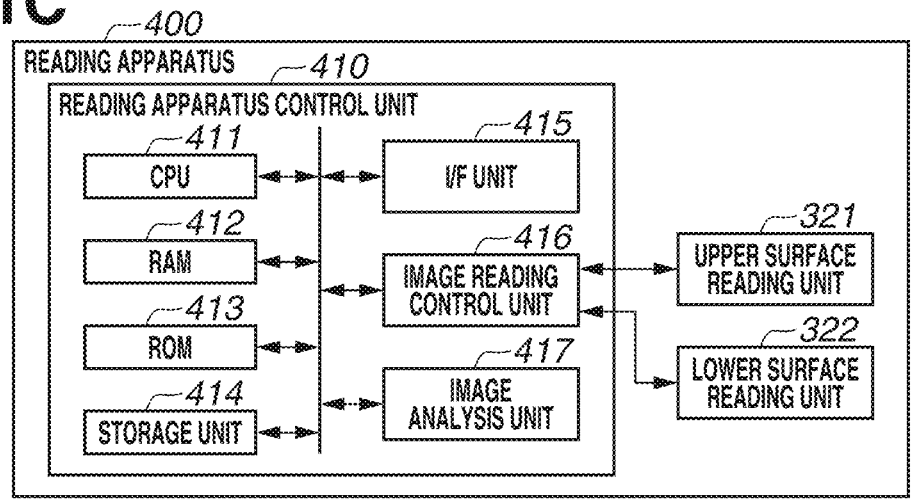
FIG. 1C is a block diagram illustrating a system configuration of a reading apparatus according to one or more aspects of the present disclosure.

FIG. 1C is a block diagram of the reading apparatus 400. The reading apparatus 400 includes a reading apparatus control unit 410, the upper surface reading unit 321, and the lower surface reading unit 322. The reading apparatus control unit 410 includes a CPU 411, a RAM 412, a ROM 413, a storage unit 414, an I/F unit 415, an image reading control unit 416, and an image analysis unit 417.

The CPU 411 controls the operation of the reading apparatus 400, and operates based on programs stored in the ROM 413 and loaded into the RAM 412. The storage unit 414 stores information for storing information to be used in control of the reading apparatus 400, and programs for controlling the operation of the reading apparatus 400. The I/F unit 415 is connected to the printer control unit 210, and exchanges information such as an analysis result of image data read by the reading apparatus 400. The image reading control unit 416 controls the upper surface reading unit 321 and the lower surface reading unit 322. The image analysis unit 417 analyzes images read by the upper surface reading unit 321 and the lower surface reading unit 322.

Figure 2B:
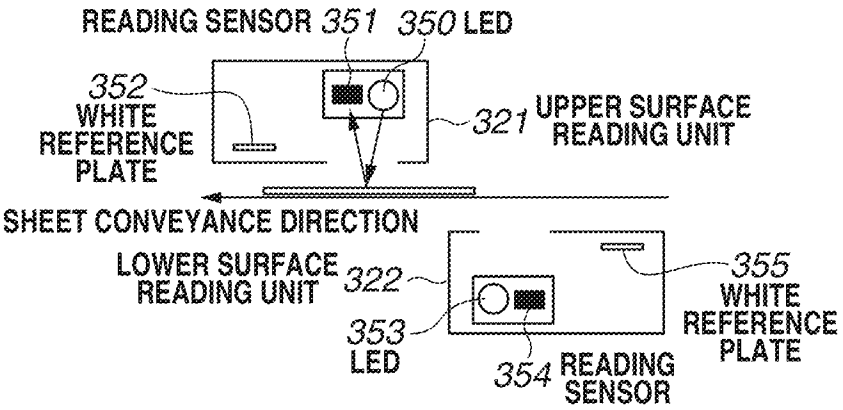
FIG. 2B is a diagram illustrating a configuration of the reading apparatus according to one or more aspects of the present disclosure.

As illustrated in FIG. 2B, the upper surface reading unit 321 is a CIS unit for reading the upper surface of a sheet, and the lower surface reading unit 322 is a CIS unit for reading the lower surface of the sheet. If there is an image adjustment pattern on the sheet that is conveyed to the sheet conveyance path 323 and has reached a predetermined position, the images are read by the upper surface reading unit 321 and the lower surface reading unit 322. The CIS units may be other optical sensors such as charge-coupled device (CCD) image sensors or complementary metal-oxide-semiconductor (CMOS) image sensors. The read information is stored in the storage unit 414, analyzed by the image analysis unit 417, and fed back to image forming conditions to adjust (correct) image positions. If the temperature inside the MFP 100 rises, the positions of the images formed on a sheet vary compared to when the temperature inside the MFP 100 is low. The variation amount is obtained by reading the image adjustment pattern using the CIS units, and the image positions are adjusted based on the obtained variation amount so that the images are printed at the same positions as when the inside temperature is low. This stabilizes the image position accuracy.

Image densities may be adjusted aside from the image positions.

<Use Sequence>

Figure 8A:
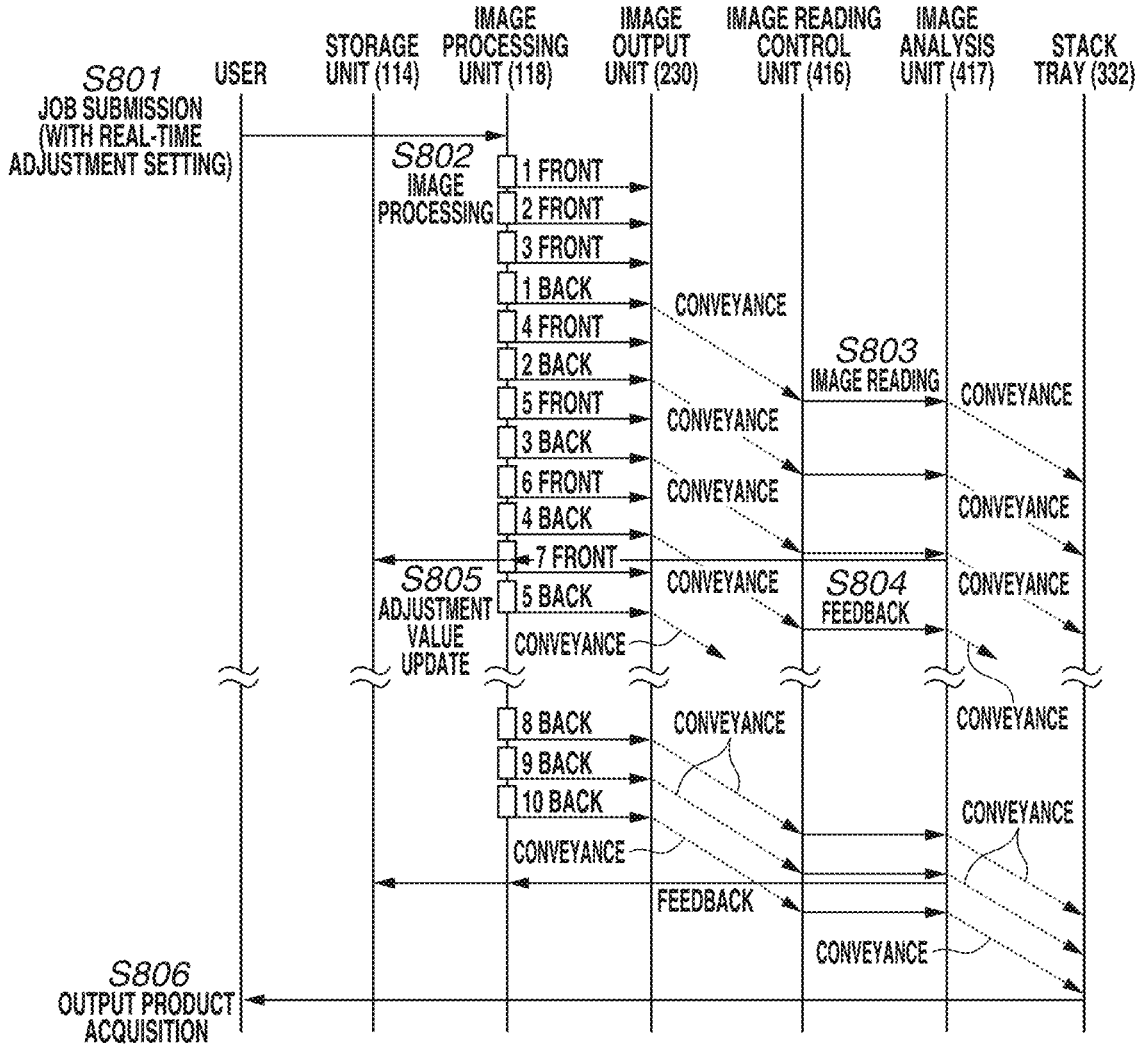
FIG. 8A is a sequence diagram illustrating a series of image forming processes according to one or more aspects of the present disclosure.
Figure 8B:
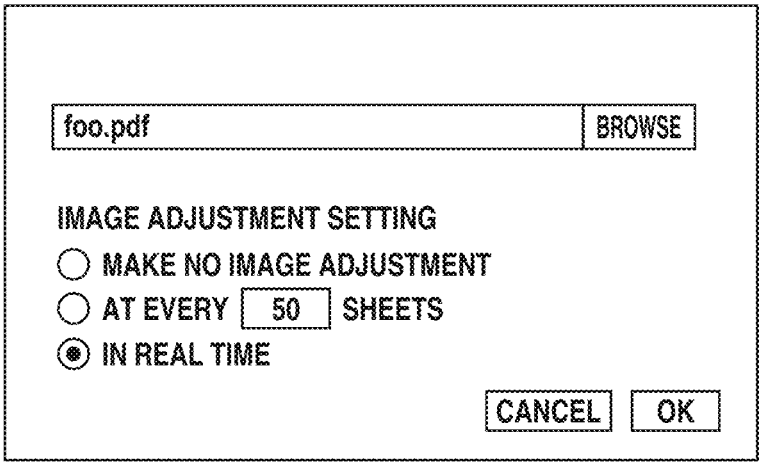
FIG. 8B is a diagram illustrating an image adjustment setting screen according to one or more aspects of the present disclosure.

FIG. 8A illustrates a sequence during which the user submits a job and then printing is performed using results of image adjustments while the image adjustments are made. In step S801, the user submits a print job. At this time, as illustrated in FIG. 8B, the print job is submitted with a real-time image adjustment setting enabled. In step S802, the image processing unit 118 sequentially processes and transfers images to the image output unit 230. The image output unit 230 sequentially conveys sheets subjected to back side printing to the subsequent stage. In step S803, the image reading control unit 416 reads the images on the conveyed sheets. The image analysis unit 417 analyzes the images. The read sheets are sequentially conveyed to the stack tray 332 at the subsequent stage. After the images on a predetermined number of sheets (three sheets in this example) are analyzed, in step S804, the image analysis unit 417 gives feedback to the image processing unit 118. In step S805, the image processing unit 118 updates adjustment values based on the received feedback, and stores the updated adjustment values in the storage unit 114. The above-described operation is repeated until all the sheets are conveyed to the stack tray 332. If all the sheets are conveyed to the stack tray 332, then in step S806, the user can acquire the output product.

<Chart>

The image reading in step S803 will be described next. FIGS. 3A, 3B, 3C, 4A, and 4B illustrate image position adjustments.

FIGS. 3A to 3C illustrate examples of images read by the reading apparatus 400 and examples of measurement values obtained by analyzing the image. The chart 900 illustrated in FIG. 3A is an example of an image position adjustment chart. FIG. 3A schematically illustrates a sheet on which image position adjustment marks are printed. The chart 901 is an example where the image position adjustment chart is overwritten on the margins (sheet ends) of the user's print image. A gray region 905 in FIG. 3A represents the area of the user's print image. The reading apparatus 400 can perform measurement (described below) using either the output (the product) with the chart 900 or the output (the product) with the chart 901. The image analysis unit 417 measures distances indicated by double arrows (A) to (J) in FIG. 3B. The double arrows (A) and (B) indicate the lengths of the chart in a main scanning direction and a sub scanning direction, respectively. The ideal lengths are the sheet lengths defined in a sheet library. The double arrows (C) to (J) each indicate a distance from a mark 902 to a nearest sheet edge. FIG. 3C illustrates examples of the measurement values measured by the reading apparatus 400 and provided as feedback to the control unit 110 via the printer control unit 210. As illustrated in a table of FIG. 3C, an adjustment value identifier (ID) is given to the feedback. Since the feedback is provided for each of the front side and the back side, the front side information or the back side information is also fed back along with the measurement values.

FIGS. 4A and 4B illustrate calculation of the adjustment values by the control unit 110 based on the feedback received from the reading apparatus 400. FIG. 4A illustrates a table 910 summarizing how to calculate print position deviation amount. An item 911 indicates by what equations the measurement values illustrated in FIG. 3C are handled. An item 912 indicates ideal values. An item 913 indicates how to calculate the adjustment values. The image processing unit 118 calculates the respective adjustment values for adjustment items 914 to 917, and stores the calculated adjustment values in the storage unit 114.

FIG. 4B illustrates a table summarizing examples of the above-described adjustment values. The adjustment values are calculated from the feedback illustrated in FIG. 3C, using the calculation method illustrated in FIG. 4A. As illustrated in the table of FIG. 4B, the adjustment values for the front side and the back side are stored as a first set of adjustment values 921. The adjustment values are updated separately for an item group 923 for the front side and an item group 924 for the back side based on the feedback.

<Feedback Timing>

FIG. 5 illustrates association between sheets and the adjustment value IDs described above. As described above, an adjustment value ID is assigned to each set of adjustment values, and the printer control unit 210 issues, to the control unit 110, an instruction about the adjustment value ID to be applied (described below). As illustrated in FIG. 5, the printer control unit 210 stores, in the storage unit 214, a table 500 for managing which adjustment value ID is applied to which sheet. At the time of image formation on the front side of a sheet, the printer control unit 210 registers the sheet number and the adjustment value ID about which the instruction has been issued to the control unit 110. Then, at the time of image formation on the back side of the sheet, the printer control unit 210 refers to the table 500, calls (determines) the adjustment value ID about which the instruction has been issued in the image formation on the front side, and issues to the control unit 110 an instruction about the called adjustment value ID. Then the control unit 110 calls, from the storage unit 114, the set of adjustment values corresponding to the adjustment value ID about which the instruction has been received from the printer control unit 210, and performs image processing using the image processing unit 118. In this manner, the image formation is performed on the front side and the back side of the same sheet by using the same adjustment value ID.

Figure 6:
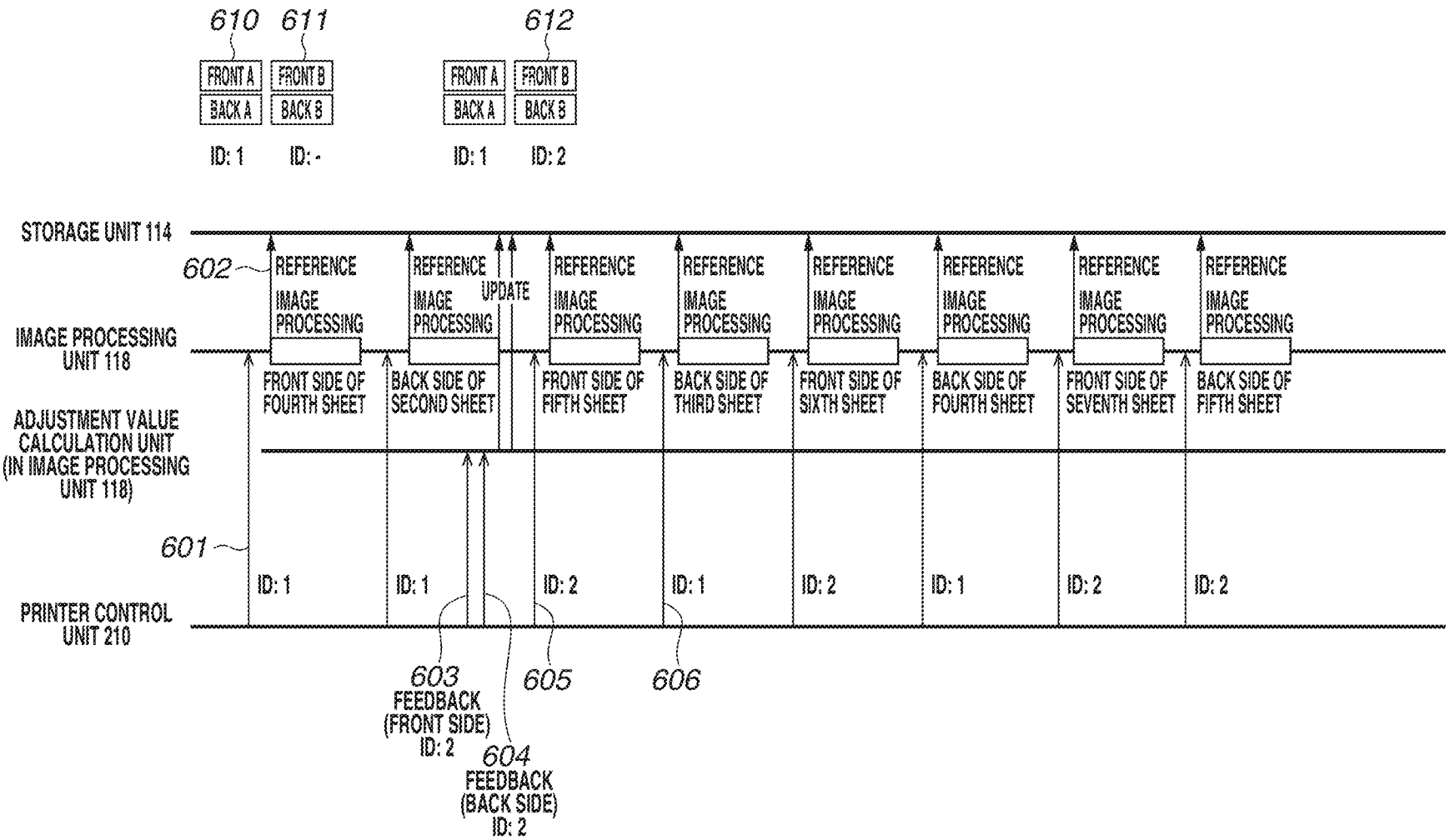
FIG. 6 is a diagram illustrating a relationship between sheet conveyance order and adjustment values according to one or more aspects of the present disclosure.

FIG. 6 schematically illustrates a sequence for updating the adjustment values while performing continuous duplex printing (a series of image forming processes). In process 601, before image generation for each page, the printer control unit 210 issues to the control unit 110 an instruction about the adjustment value ID, and registers the adjustment value ID in the management table (the table 500) illustrated in FIG. 5. In process 602, the image processing unit 118 in the control unit 110 that has received the instruction refers to the set of adjustment values stored in the storage unit 114, based on the received instruction, and performs image processing. An adjustment value set 610 and an adjustment value set 611 schematically represent the first set of adjustment values 921 and a second set of adjustment values 922 illustrated in FIG. 4B, respectively. At the beginning of the sequence in FIG. 6, since an adjustment value ID of 1 is assigned to the adjustment value set 610, the image processing unit 118 refers to the adjustment value set 610 (the first set of adjustment values 921) to performs image processing. In processes 603 and 604, the printer control unit 210 gives feedback with an adjustment value ID of 2 to the control unit 110. The image processing unit 118 in the control unit 110 calculates the adjustment values and stores the calculated adjustment values in the storage unit 114. At this time, the second set of adjustment values 922 represented by an adjustment value set 612 is updated. FIG. 6 illustrates the assignment of the adjustment value ID of 2 to the adjustment value set 612. In process 605, before image generation for the front side after the feedback in processes 603 and 604, the printer control unit 210 issues an instruction about the latest adjustment value ID. In process 606, before image generation for the back side, the printer control unit 210 refers to the table 500 illustrated in FIG. 5, calls the adjustment value ID about which the instruction has been issued before the image generation for the front side, and issues an instruction about the called adjustment value ID.

<Control Flow>

Figure 7A:
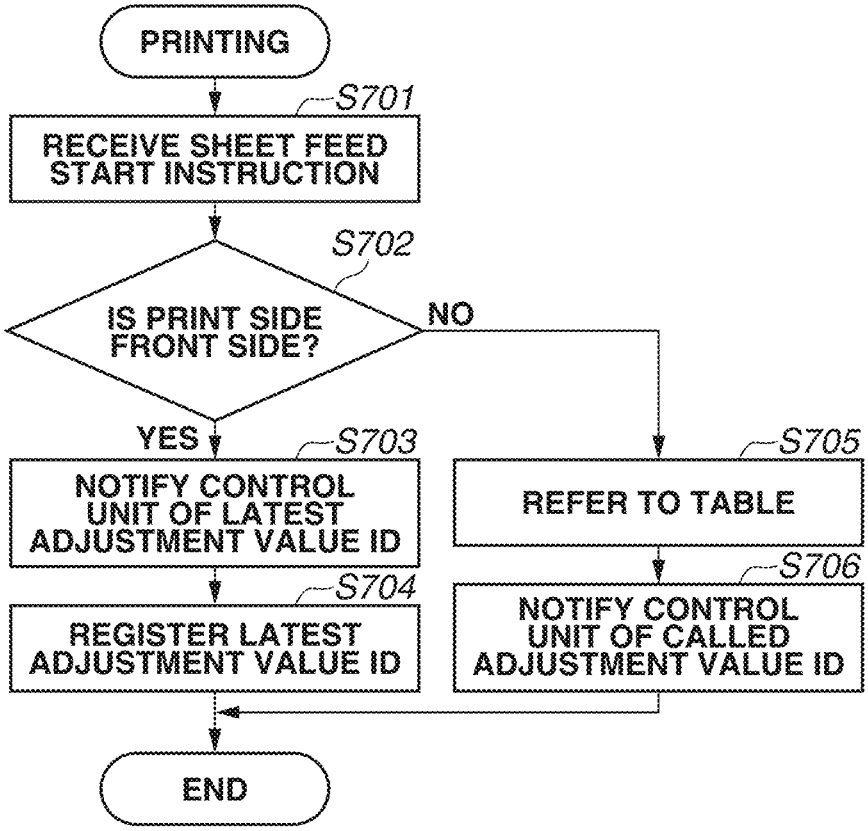
FIG. 7A is a flowchart illustrating adjustment value registration processing according to one or more aspects of the present disclosure.
Figure 7B:
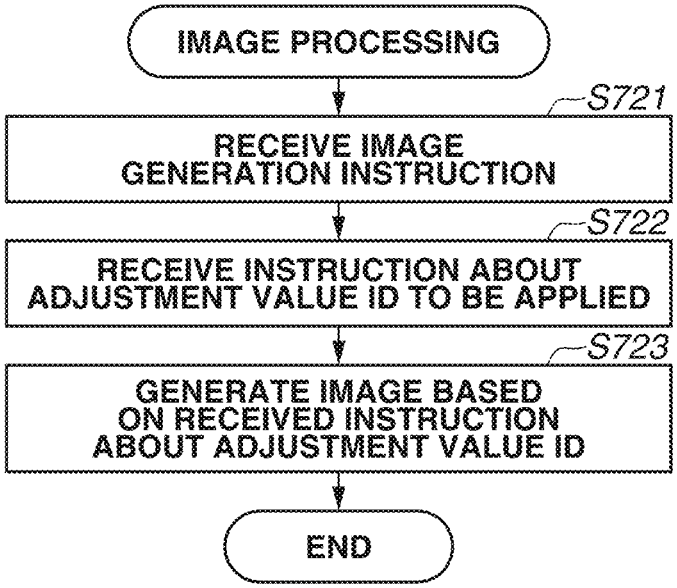
FIG. 7B is a flowchart illustrating adjustment value reflection processing according to one or more aspects of the present disclosure.

FIGS. 7A and 7B are flowcharts illustrating processing performed by the printer control unit 210 and the image processing unit 118. FIG. 7A is a flowchart illustrating processing performed by the printer control unit 210 at the start of image processing. This processing is implemented by the CPU 211 loading a program stored in the ROM 213 into the RAM 212 and executing the program. In step S701, the CPU 211 receives a sheet feed start instruction from the control unit 110. In step S702, the CPU 211 determines whether the side of a sheet to be printed (the print side) is the front side. If the print side is the front side (YES in step S702), the processing proceeds to step S703. In step S703, the CPU 211 notifies the control unit 110 of the latest adjustment value ID. In step S704, the CPU 211 registers the latest adjustment value ID. If the print side is the back side (NO in step S702), the processing proceeds to step S705. In step S705, the CPU 211 refers to the table 500 stored in the storage unit 214, and calls the adjustment value ID corresponding to the sheet. In step S706, the CPU 211 notifies the control unit 110 of the called adjustment value ID.

FIG. 7B is a flowchart illustrating image processing performed by the image processing unit 118. This processing is implemented by the CPU 111 loading a program stored in the ROM 113 into the RAM 112 and executing the program. In step S721, the CPU 111 receives an image generation instruction. In step S722, the CPU 111 receives, from the printer control unit 210, an instruction about the adjustment value ID to be applied to the image processing. In step S723, the CPU 111 generates an image based on the received instruction about the adjustment value ID.

Figure 10:
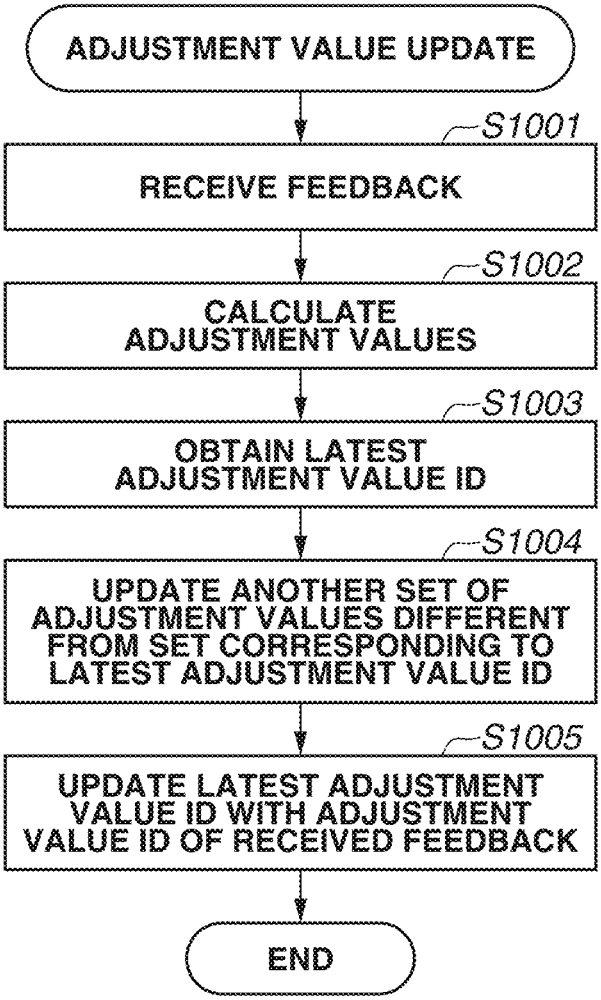
FIG. 10 is a flowchart illustrating adjustment value update control according to one or more aspects of the present disclosure.

FIG. 10 is a flowchart illustrating adjustment value update processing. This processing is implemented by the CPU 111 loading a program stored in the ROM 113 into the RAM 112 and executing the program. In step S1001, the CPU 111 receives feedback from the printer control unit 210 (e.g., the feedback in processes 603 and 604 illustrated in FIG. 6). In step S1002, the CPU 111 calculates the adjustment values based on the received feedback. In step S1003, the CPU 111 obtains the latest adjustment value ID. In step S1004, the CPU 111 updates another set of adjustment values different from the set corresponding to the latest adjustment value ID. In step S1005, the CPU 111 updates the latest adjustment value ID with the adjustment value ID of the received feedback. In other words, the set including the adjustment values after the update and the set including the adjustment values before the update are replaced with each other as appropriate. The number of sets of adjustment values to be stored is made smaller than the total number of sets of adjustment values to be updated during the series of processes.

Figure 9:
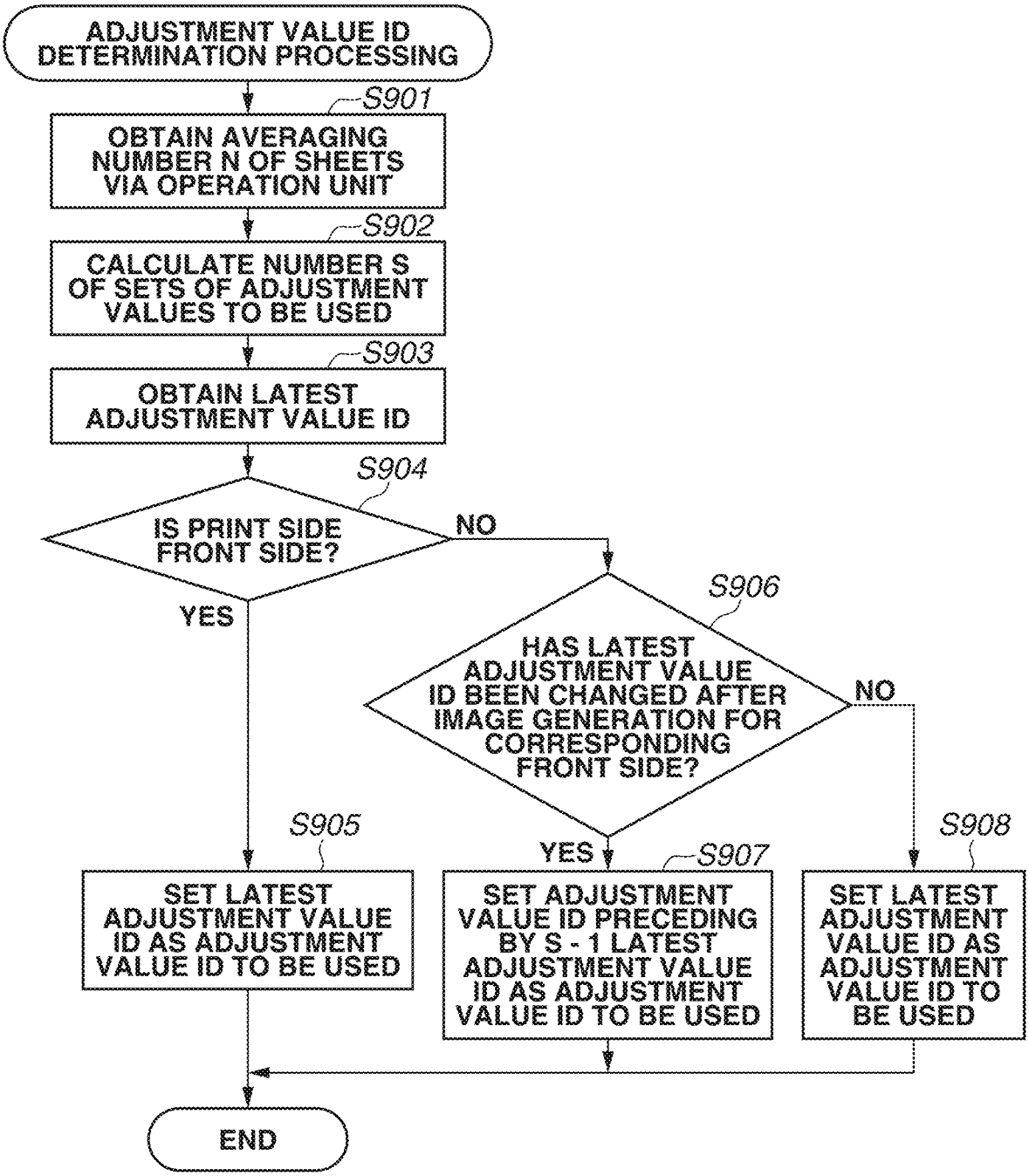
FIG. 9 is a flowchart illustrating adjustment value reflection control during printing according to one or more aspects of the present disclosure.

FIG. 9 is a flowchart illustrating processing performed by the printer control unit 210 to determine the appropriate adjustment value ID for image generation without using the table 500 in step S705 in FIG. 7A. This processing is implemented by the CPU 211 loading a program stored in the ROM 213 into the RAM 212 and executing the program. In step S901, the CPU 211 obtains the number N of sheets for averaging the adjustment values (hereinafter referred to as the averaging number N of sheets), which is input via the operation unit 150. As illustrated in FIG. 8B, the averaging number N of sheets is set based on every how many sheets the real-time image adjustment is to be made. In step S902, the CPU 211 calculates the number S of adjustment value sets to be used. The number S of adjustment value sets is expressed by the following equation (1):

$$S = \begin{cases} 2 & (\text{if } M \leq N) \\ M/N & (\text{if } M > N \text{ and } M \bmod N = 0), \\ M/N + 1 & (\text{if } M > N \text{ and } M \bmod N \neq 0) \end{cases} \quad (1)$$

where M is the number of sheets to be circulated (conveyed cyclically) in the MFP 100, which is inherent in each model. The calculation result of M/N after the decimal point is rounded down.

In step S903, the CPU 211 obtains the latest adjustment value ID. In step S904, the CPU 211 determines whether the print side is the front side. If the print side is the front side (YES in step S904), the processing proceeds to step S905. In step S905, the CPU 211 sets the latest adjustment value ID as the adjustment value ID to be used for image generation. If the print side is the back side (NO in step S904), the processing proceeds to step S906. In step S906, the CPU 211 determines whether the latest adjustment value ID has been changed after the image generation for the corresponding front side. If the latest adjustment value ID has been changed (YES in step S906), the processing proceeds to step S907. In step S907, the CPU 211 sets the adjustment value ID preceding by S−1 the latest adjustment value ID as the adjustment value ID to be used for image generation. If the latest adjustment value ID has not been updated (NO in step S906), the processing proceeds to step S908. In step S908, the CPU 211 sets the latest adjustment value ID as the adjustment value ID to be used for image generation.

Figure 11A:
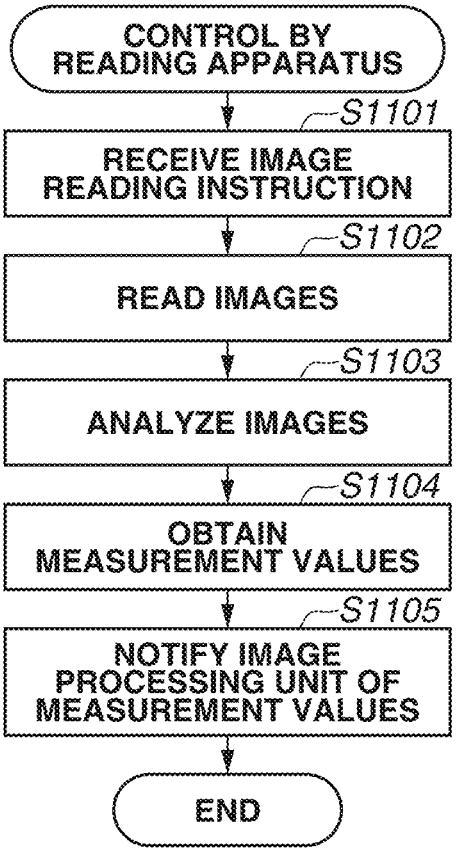
FIG. 11A is a flowchart illustrating control by the reading apparatus according to one or more aspects of the present disclosure.
Figure 11B:
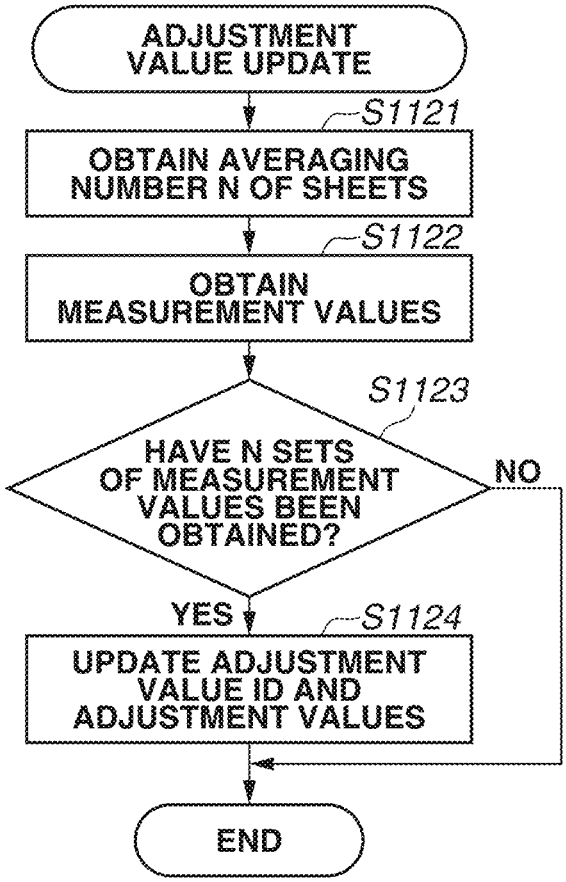
FIG. 11B is a flowchart illustrating adjustment value update control according to one or more aspects of the present disclosure.

FIGS. 11A and 11B are flowcharts illustrating processing performed by the reading apparatus control unit 410 and the printer control unit 210. FIG. 11A is a flowchart illustrating processing where the reading apparatus 400 reads an image adjustment chart and notifies the printer control unit 210 of the measurement values. This processing is implemented by the CPU 411 loading a program stored in the ROM 413 into the RAM 412 and executing the program. In step S1101, the CPU 411 receives an image reading instruction. In step S1102, the CPU 411 reads the images. In step S1103, the CPU 411 analyzes the images. In step S1104, the CPU 411 obtains the measurement values. In step S1105, the CPU 411 notifies the image processing unit 118 of the measurement values. FIG. 11B is a flowchart illustrating processing where the printer control unit 210 obtains the measurement values (the reading results) of as many sheets as the averaging number N of sheets and updates the adjustment value ID. This processing is implemented by the CPU 211 loading a program stored in the ROM 213 into the RAM 212 and executing the program. In step S1121, the CPU 211 obtains the averaging number N of sheets for averaging the adjustment values, which is input via the operation unit 150. In step S1122, the CPU 211 obtains the measurement values from the reading apparatus 400.

In step S1123, the CPU 211 determines whether N sets of measurement values have been obtained. If N sets of measurement values have been obtained (YES in step S1123), the processing proceeds to step S1124. In step S1124, the CPU 211 updates the adjustment value ID and the adjustment values. At this time, the adjustment value ID is updated by incrementing the current adjustment value ID. The upper limit of the adjustment value ID is S. If the incremented adjustment value ID is S+1, the adjustment value ID is updated to 1. The adjustment values are updated with the averages of the obtained measurement values. If N sets of measurement values have not been obtained (NO in step S1123), the processing ends.

As described above, according to the present exemplary embodiment, in a part of the period of the series of image forming processes, an image on the first side (the front side) of a sheet can be adjusted using one of the sets of adjustment values, and an image on the second side (the back side) of a sheet can be adjusted using another set of adjustment values. Therefore, appropriate image adjustments can be reflected in both the front side and the back side regardless of the update timing of the adjustment values.

An image forming system according to a second exemplary embodiment has a similar configuration to that of the image forming system according to the first exemplary embodiment except for some characteristic components. Similar components will thus be denoted by the same reference numerals, and a detailed description thereof will be omitted.

In the second exemplary embodiment, the control unit 110 stores, in the storage unit 114, a table for managing which adjustment value ID is applied to which sheet, such as the table 500 illustrated in FIG. 5. In image formation on the front side of a sheet, the control unit 110 registers the sheet number and the adjustment value ID applied by the image processing unit 118. Then, in image formation on the back side of the sheet, the control unit 110 refers to the table (e.g., the table 500), calls (determines) the adjustment value ID applied to the image formation on the front side, and applies the called adjustment value ID to perform image processing using the image processing unit 118. In such a manner, the image formation on the front side and the back side of the same sheet is performed by using the same adjustment value ID.

<Feedback Timing>

Figure 12:
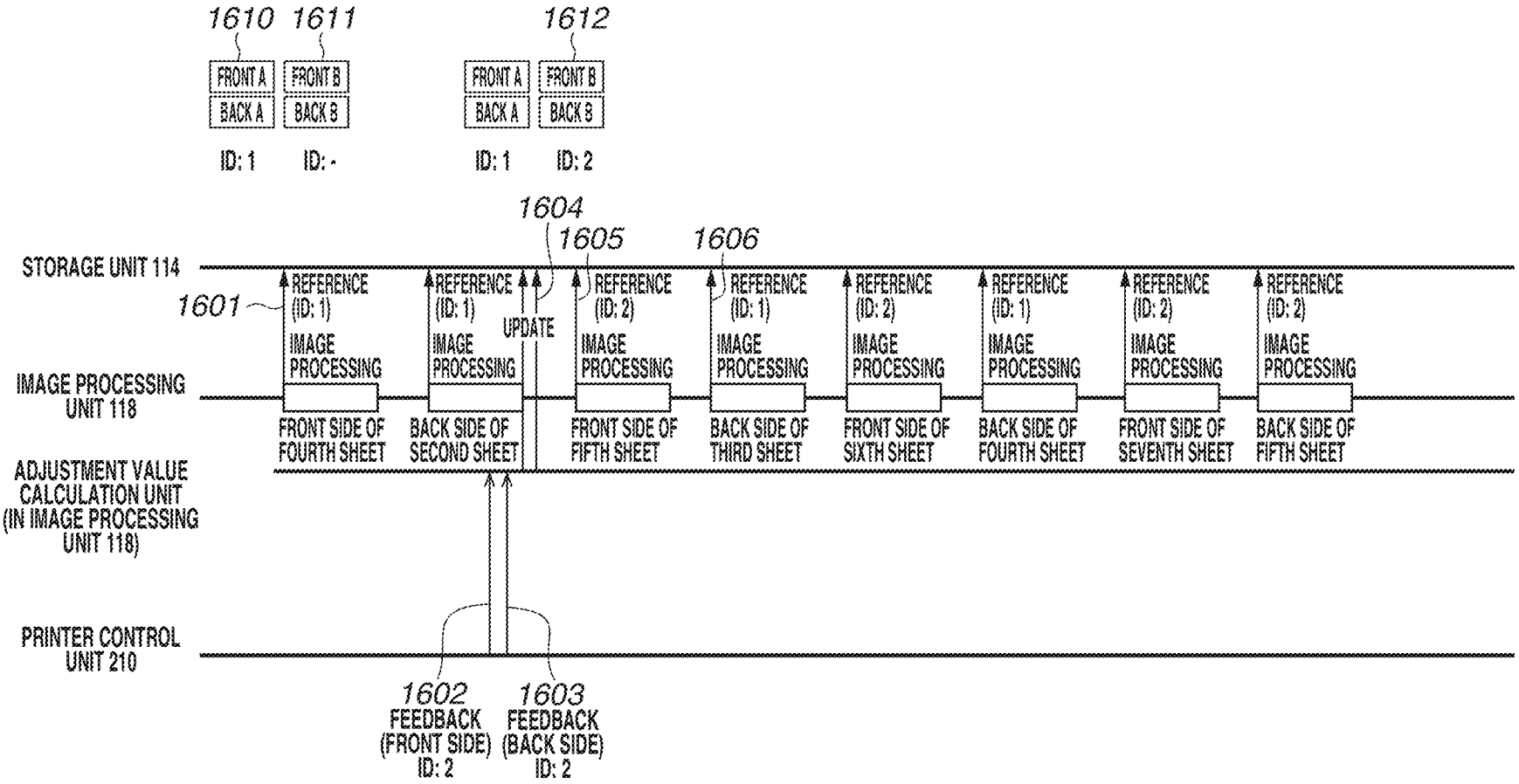
FIG. 12 is a diagram illustrating a relationship between sheet conveyance order and adjustment values according to one or more aspects of the present disclosure.

FIG. 12 schematically illustrates a sequence for updating the adjustment values while performing continuous duplex printing (a series of image forming processes). In process 1601, the image processing unit 118 determines the adjustment value ID to be applied to image processing for each page, refers to a set of adjustment values in the storage unit 114 based on the determination result, and performs the image processing. An adjustment value set 1610 and an adjustment value set 1611 schematically represent the first set of adjustment values 921 and the second set of adjustment values 922 illustrated in FIG. 4B, respectively. At the beginning of the sequence in FIG. 12, since an adjustment value ID of 1 is assigned to the adjustment value set 1610, the image processing unit 118 refers to the adjustment value set 1610 (the first set of adjustment values 921) to perform the image processing. In processes 1602 and 1603, the printer control unit 210 gives feedback with an adjustment value ID of 2 to the control unit 110. In process 1604, the control unit 110 calculates the adjustment values using the image processing unit 118, and stores the calculated adjustment values in the storage unit 114.

At this time, the second set of adjustment values 922 represented by an adjustment value set 1612 is updated. FIG. 12 illustrates the assignment of the adjustment value ID of 2 to the adjustment value set 1612. In process 1605, the image processing unit 118 applies the latest adjustment value ID to image processing on the front side after the feedback in processes 1602 and 1603. In process 1606, the image processing unit 118 refers to the table 500 illustrated in FIG. 5, calls the adjustment value ID determined before the image generation for the front side, and applies the called adjustment value ID to image processing on the back side.

<Control Procedure>

Figure 13:
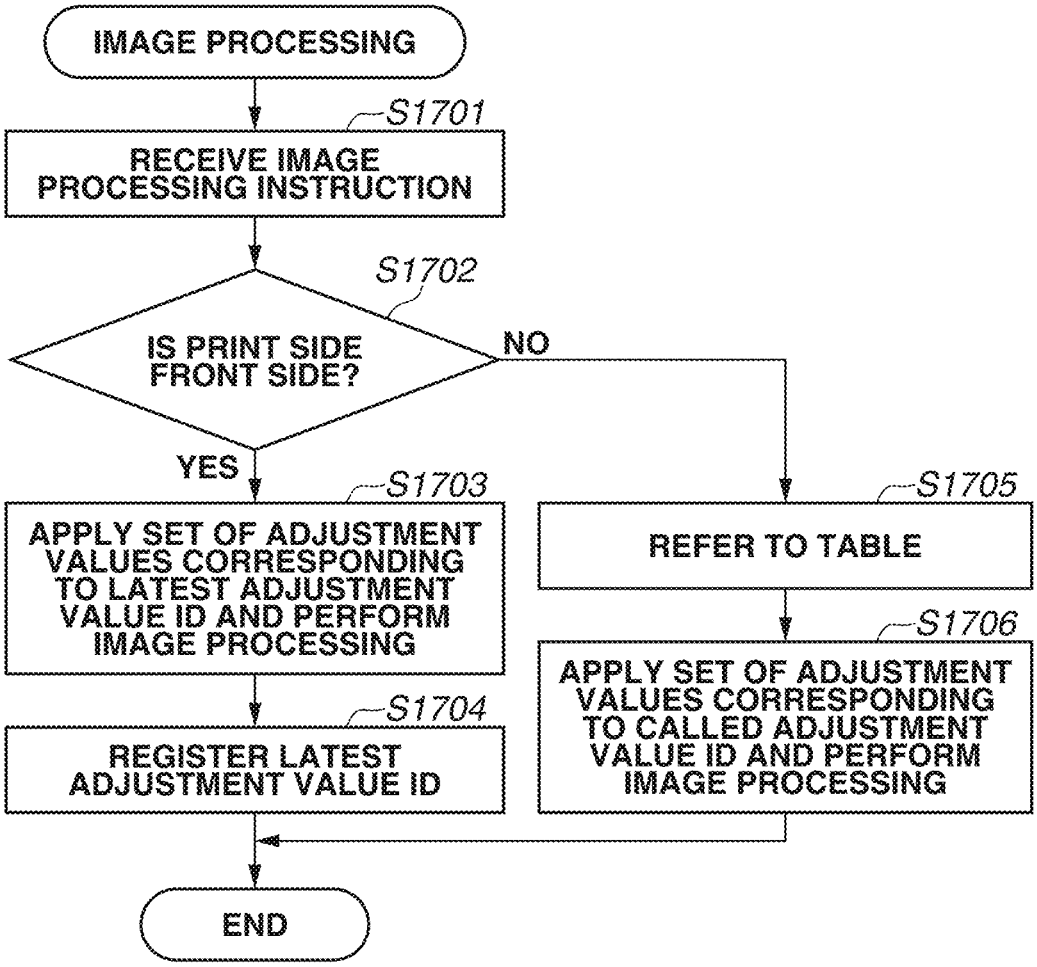
FIG. 13 is a flowchart illustrating adjustment value reflection control during printing according to one or more aspects of the present disclosure.

FIG. 13 is a flowchart illustrating processing performed by the image processing unit 118. This processing is implemented by the CPU 11I loading a program stored in the ROM 113 into the RAM 112 and executing the program. In step S1701, the CPU 111 receives an image processing instruction from the control unit 110. In step S1702, the CPU 111 determines whether the print side is the front side. If the print side is the front side (YES in step S1702), the processing proceeds to step S1703. In step S1703, the CPU 111 applies the set of adjustment values corresponding to the latest adjustment value ID, and performs image processing using the image processing unit 118. In step S1704, the CPU 111 registers the latest adjustment value ID. If the print side is the back side (NO in step S1702), the processing proceeds to step S1705. In step S1705, the CPU 111 refers to the table 500 stored in the storage unit 144 and calls the adjustment value ID corresponding to the sheet. In step S1706, the CPU 111 applies the set of adjustment values corresponding to the called adjustment value ID, and performs image processing using the image processing unit 118.

FIG. 10 is a flowchart illustrating adjustment value update processing. This processing is implemented by the CPU 11I loading a program stored in the ROM 113 into the RAM 112 and executing the program. In step S1001, the CPU 11*l* receives feedback from the printer control unit 210 (e.g., the feedback in processes 1602 and 1603 in FIG. 12). In step S1002, the CPU 111 calculates the adjustment values based on the received feedback. In step S1003, the CPU 111 obtains the latest adjustment value ID. In step S1004, the CPU 111 updates another set of adjustment values different from the set corresponding to the latest adjustment value ID. In other words, the set including the adjustment values after the update and the set including the adjustment values before the update are replaced with each other as appropriate. Thus, the number of sets of adjustment values to be stored is made smaller than the total number of sets of adjustment values to be updated during the series of processes. In step S1005, the CPU 111 updates the latest adjustment value ID with the adjustment value ID of the received feedback.

FIG. 9 is a flowchart illustrating processing performed by the image processing unit 118 to determine the appropriate adjustment value ID for image generation without using the table 500 in step S1705 in FIG. 13. This processing is implemented by the CPU 111 loading a program stored in the ROM 113 into the RAM 112 and executing the program. In step S901, the CPU 111 obtains the averaging number N of sheets for averaging the adjustment values, which is input via the operation unit 150. As illustrated in FIG. 8B, the averaging number N of sheets is set based on every how many sheets the real-time image adjustment is to be made. In step S902, the CPU 111 calculates the number S of adjustment value sets to be used. The number S of adjustment value sets is expressed by the foregoing equation (1), where M is the number of sheets to be circulated (conveyed cyclically) in the MFP 100, which is inherent in each model. The calculation result of M/N after the decimal point is rounded down.

In step S903, the CPU 111 obtains the latest adjustment value ID. In step S904, the CPU 111 determines whether the print side is the front side. If the print side is the front side (YES in step S904), the processing proceeds to step S905. In step S905, the CPU 111 sets the latest adjustment value ID as the adjustment value ID to be used for image generation. If the print side is the back side (NO in step S904), the processing proceeds to step S906. In step S906, the CPU 111 determines whether the latest adjustment value ID has been changed after the image generation for the corresponding front side. If the latest adjustment value ID has been changed (YES in step S906), the processing proceeds to step S907. In step S907, the CPU 111 sets the adjustment value ID preceding by S−1 the latest adjustment value ID as the adjustment value ID to be used for image generation. If the latest adjustment value ID has not been updated (NO in step S906), the processing proceeds to step S908. In step S908, the CPU 111 sets the latest adjustment value ID as the adjustment value ID to be used for image generation.

FIGS. 11A and 11B are flowcharts illustrating processing performed by the reading apparatus 400 and the image processing unit 118 during image formation. FIG. 11A illustrates processing where the reading apparatus 400 reads an image adjustment chart and notifies the image processing unit 118 of the measurement values. This processing is implemented by the CPU 411 loading a program stored in the ROM 413 into the RAM 412 and executing the program. In step S1101, the CPU 411 receives an image reading instruction. In step S1102, the CPU 411 reads the images. In step S1103, the CPU 411 analyzes the images. In step S1104, the CPU 411 obtains the measurement values (the reading results). In step S1105, the CPU 411 notifies the image processing unit 118 of the measurement values. FIG. 11B is a flowchart illustrating processing where the image processing unit 118 obtains the measurement values of as many sheets as the averaging number N of sheets and updates the adjustment value ID. This processing is implemented by the CPU 111 loading a program stored in the ROM 113 into the RAM 112 and executing the program. In step S1121, the CPU 111 obtains the averaging number N of sheets for averaging the adjustment values, which is input via the operation unit 150. In step S1122, the CPU 111 obtains the measurement values from the reading apparatus 400.

In step S1123, the CPU 111 determines whether N sets of measurement values have been obtained. If N sets of measurement values have been obtained (YES in step S1123), the processing proceeds to step S1124. In step S1124, the CPU 111 updates the adjustment value ID and the measurement values. At this time, the adjustment value ID is updated by incrementing the current adjustment value ID. The upper limit of the adjustment value ID is S. If the incremented adjustment value ID is S+1, the adjustment value ID is updated to 1. The adjustment values are updated with the averages of the obtained measurement values. If N sets of measurement values have not been obtained (NO in step S1123), the processing ends.

As described above, according to the present exemplary embodiment, in a part of the period of the series of image forming processes, an image on the first side (the front side) of a sheet can be adjusted using one of the sets of adjustment values, and an image on the second side (the back side) of a sheet can be adjusted using another set of adjustment values. Therefore, appropriate image adjustments can be reflected in both the front side and the back side regardless of the update timing of the adjustment values.

An image forming system according to a third exemplary embodiment has a similar configuration to that of the image forming system according to the first exemplary embodiment except for some characteristic components. Similar components will thus be denoted by the same reference numerals, and a detailed description thereof will be omitted.

<Use Sequence>

A use sequence of the image forming system will be described. In the present exemplary embodiment, a plurality of sheets is read by the reading apparatus 400 concurrently with a series of image forming processes for continuous image formation on the plurality of sheets. The reading results are fed back during the series of image forming processes, whereby the details of the subsequent image forming process are adjusted. Particularly, in the present exemplary embodiment, the feedback timing of the reading results is adjusted so that the reading results obtained at the same timing are reflected in the front side and the back side of the same sheet. A specific description thereof will be given with reference to FIG. 17. For the sake of simplicity, in the present exemplary embodiment, the series of image forming processes will be described on the assumption that the number of sheets to be retained in the MFP 100 is small.

Figure 16A:
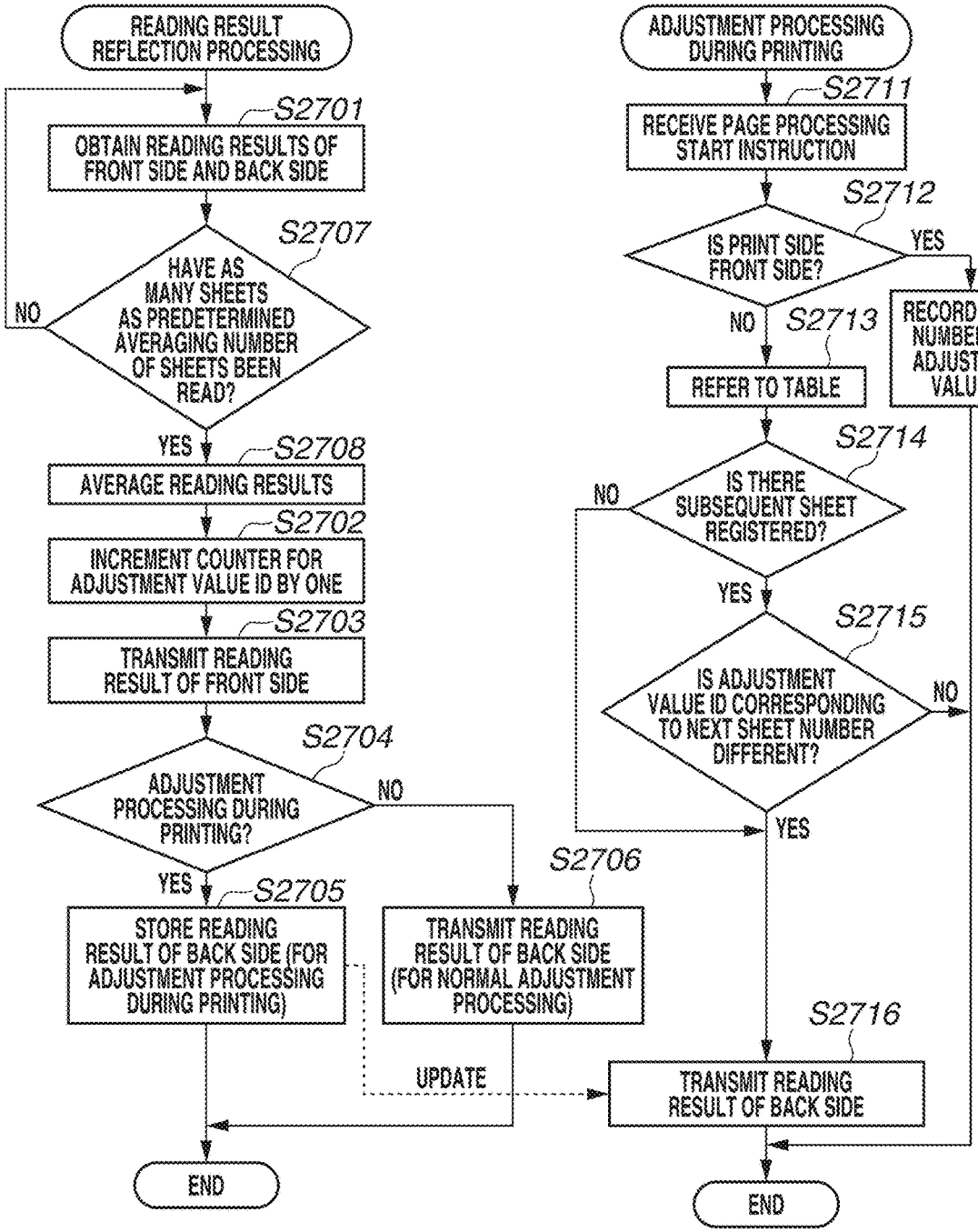
FIG. 16A is a flowchart illustrating reading result transmission control according to one or more aspects of the present disclosure.
Figure 16B:
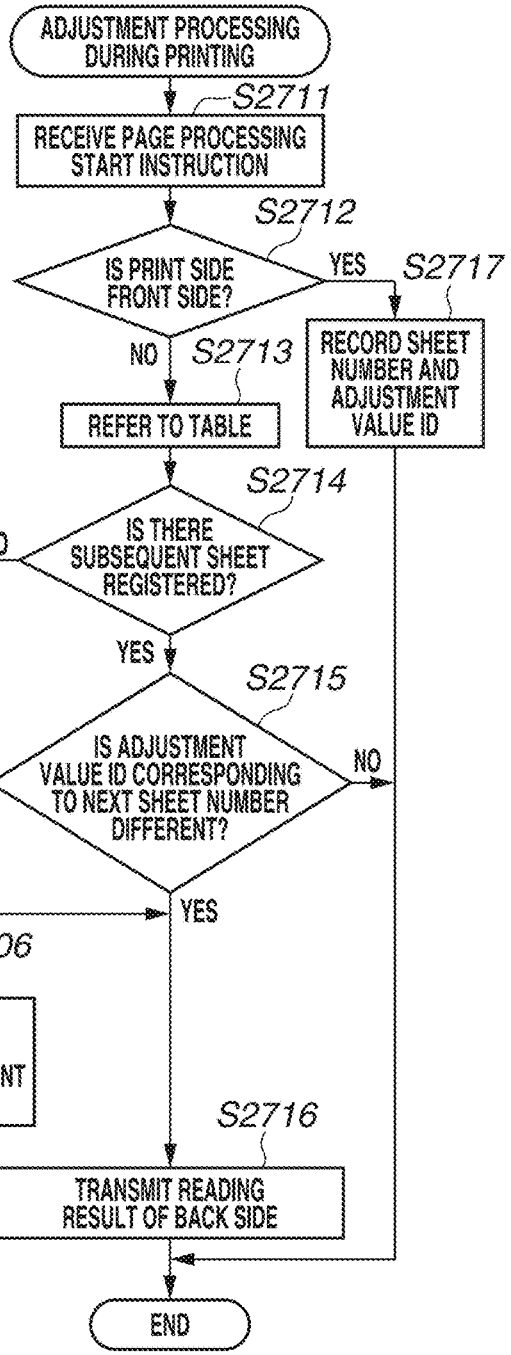
FIG. 16B is a flowchart illustrating adjustment value reflection control according to one or more aspects of the present disclosure.
Figure 17:
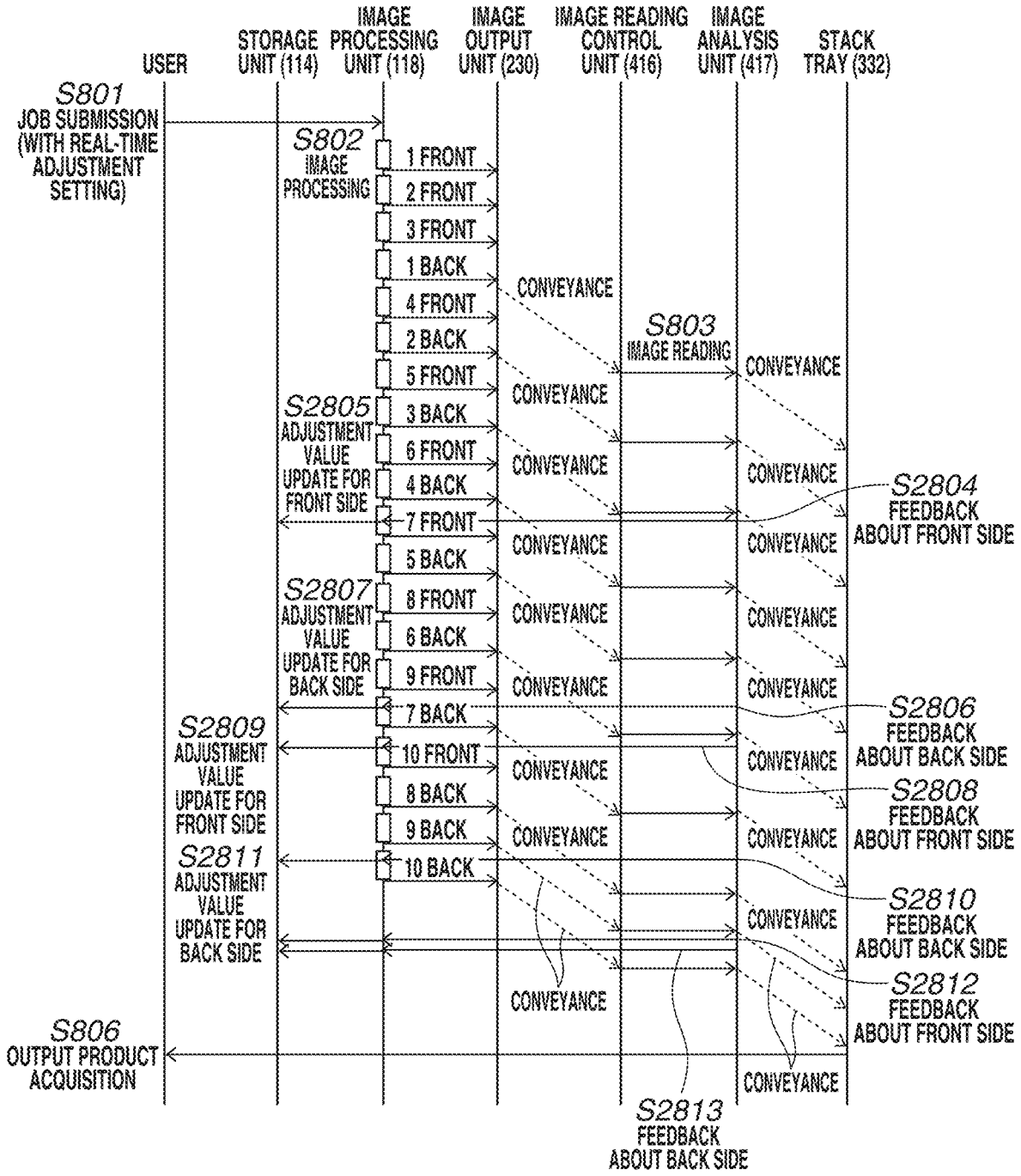
FIG. 17 is a sequence diagram illustrating a series of image forming processes according to one or more aspects of the present disclosure.

FIG. 17 illustrates a sequence of a series of image forming processes during which the user submits a job and then printing is performed using results of image adjustments while the image adjustments are made. In step S801, the user submits a print job. Suppose, as illustrated in FIG. 8B, that the print job is submitted with the real-time image adjustment setting enabled. In step S802, the image processing unit 118 sequentially processes and transfers images to the image output unit 230. The image output unit 230 sequentially conveys sheets subjected to back side printing to the subsequent stage. In step S803, the image reading control unit 416 reads the images on the conveyed sheets. The image analysis unit 417 analyzes the images. The read sheets are sequentially conveyed to the stack tray 332 at the subsequent stage. During the series of image forming processes, the image analysis unit 417 analyzes the images on a predetermined number of sheets (three sheets in this example) and obtains feedback values (update information) about the front side and feedback values (update information) about the back side. In step S2804, the image analysis unit 417 first gives feedback about the front side to the image processing unit 118. In step S2805, the image processing unit 118 updates the adjustment values for the front side based on the received feedback values (update information) and stores (sets) the updated adjustment values into the storage unit 114. The adjustment values updated in step S2805 is applied starting from the front side of the eighth sheet. Accordingly, the image analysis unit 417 gives feedback about the back side so that the updated adjustment values are applied starting from the back side of the eighth sheet. More specifically, the image analysis unit 417 gives the feedback about the back side in step S2806 after issue of a sheet feed instruction for the back side of the seventh sheet (after a predetermined period of time). At the timing of the feedback about the back side, in step S2807, the image processing unit 118 updates the adjustment values for the back side based on the feedback values (the update information) and stores (sets) the updated adjustment values into the storage unit 114. After the image analysis unit 417 analyzes the images on a predetermined number of subsequent sheets, in step S2808, the image analysis unit 417 gives feedback about the front side. In step S2809, the image processing unit 118 updates the adjustment values for the front side and stores the updated adjustment values in the storage unit 114. In step S2810, at the timing when the last page (the back side of the tenth sheet) is processed, the CPU 211 determines that there is no subsequent sheet (NO in step S2714, see FIG. 16B). The image analysis unit 417 gives feedback about the back side at this timing. In step S2811, the image processing unit 118 updates the adjustment values for the back side based on the feedback and stores the updated adjustment values in the storage unit 114. The image analysis unit 417 analyses the images on a predetermined number of subsequent sheets. In step S2812, the image analysis unit 417 gives feedback about the front side. In step S2813, the image analysis unit 417 also gives feedback about the back side since print processing has already been completed (NO in step S2704, see FIG. 16A). After all the sheets are conveyed to the stack tray 332, in step S806, the user can acquire the output product.

<Feedback Timing>

Figure 15:
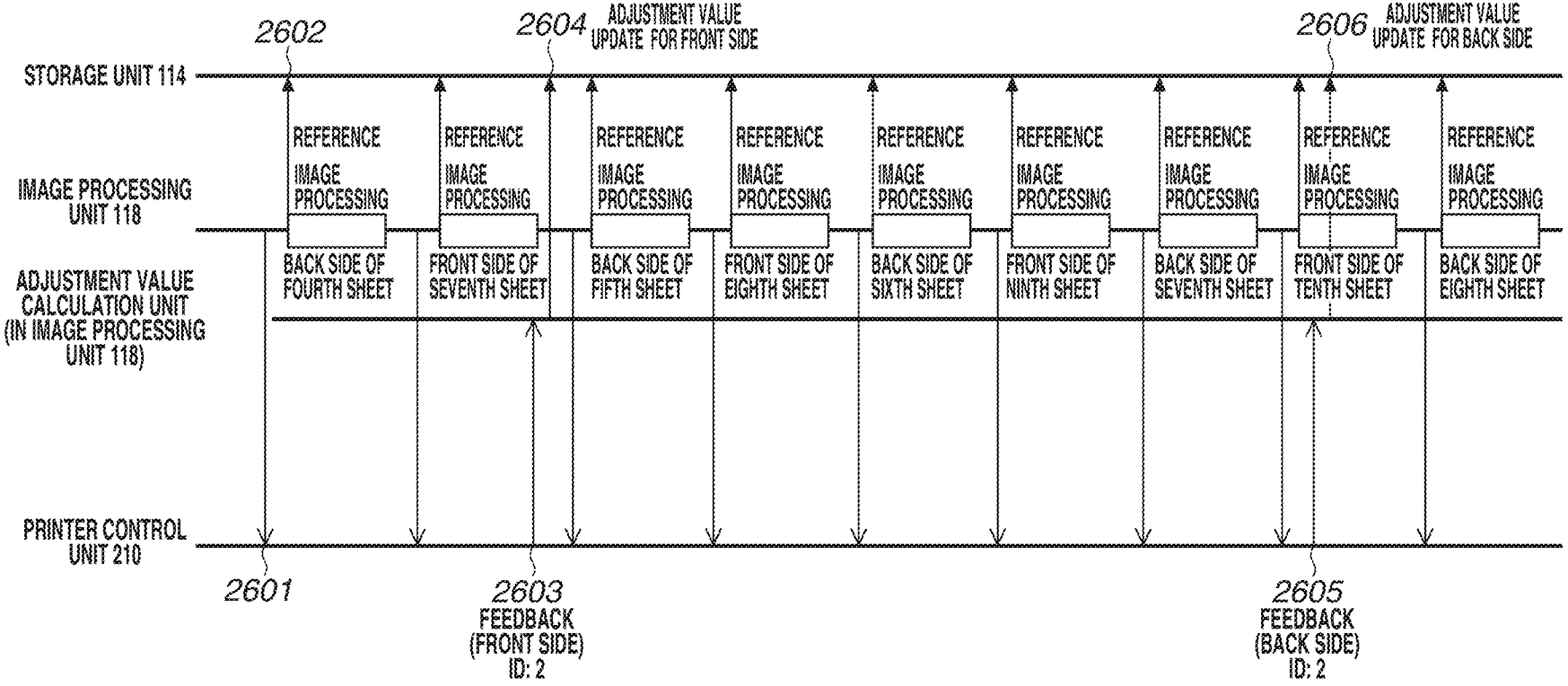
FIG. 15 is a diagram illustrating a relationship between sheet conveyance order and adjustment values according to one or more aspects of the present disclosure.

FIG. 15 schematically illustrates a sequence for updating the adjustment values while performing continuous duplex printing.

In process 2601, the printer control unit 210 receives a sheet feed start instruction for each page. The sheet feed start instruction is issued to notify the printer control unit 210 of the page number and the sheet number, for example. In process 2602, the image processing unit 118 refers to the adjustment values to be applied to image processing for each page in the storage unit 114, and performs the image processing. In process 2603, the printer control unit 210 gives feedback with an adjustment value ID of 2 for the front side to the control unit 110. In process 2604, the control unit 110 calculates the adjustment values using the image processing unit 118 and stores the calculated adjustment values in the storage unit 114. At this time, the adjustment values represented by the item group 923 in FIG. 4B are updated. The updated adjustment values are applied starting from the front side of the eighth sheet. In process 2605, the printer control unit 210 gives feedback with the adjustment value ID of 2 for the back side before image processing on the back side of the eight sheet. More specifically, the printer control unit 210 gives feedback with the adjustment value ID of 2 for the back side in response to receiving a sheet feed start instruction after the image processing unit 118 performs image processing on the back side of the seventh sheet. In process 2606, the control unit 110 calculates the adjustment values using the image processing unit 118, and stores the calculated adjustment values in the storage unit 114. At this time, the adjustment values represented by the item group 924 in FIG. 4B are updated.

FIG. 14 illustrates association between sheets and the above-described adjustment value IDs. As described above, the adjustment values are managed by assigning an adjustment value ID thereto. The printer control unit 210 stores a table for managing relationship information about which adjustment value ID is applied to which sheet, such as a table 2500 illustrated in FIG. 14, in the storage unit 214. Thus the printer control unit 210, which is notified of the sheet number by the image processing unit 118, can manage the adjustment value ID in association with the sheet number.

<Control Flow>

FIGS. 16A and 16B are flowcharts illustrating processing performed by the printer control unit 210. The processing is implemented by the CPU 211 loading a program stored in the ROM 213 into the RAM 212 and executing the program. FIG. 16A is a flowchart illustrating reading result reflection processing.

When obtaining reading results, the reading apparatus control unit 410 sequentially transmits the reading results to the printer control unit 210. In step S2701, the CPU 211 obtains the reading results of the front side and the back side of a sheet. In step S2707, the CPU 211 determines whether as many sheets as a predetermined averaging number N of sheets have been read. Here, the averaging number N of sheets refers to a numerical value for calculating the averages of the reading results, which is stored in the image forming system. If as many sheets as the averaging number N of sheets have been read (YES in step S2707), the processing proceeds to step S2708. In step S2708, the CPU 211 averages the reading results obtained so far.

In step S2702, the CPU 211 increments a counter for the adjustment value ID by one. In step S2703, the CPU 211 transmits the reading result of the front side to the control unit 110. In step S2704, the CPU 211 determines whether the adjustments are to be made during printing. If the adjustments are to be made during printing (YES in step S2704), the processing proceeds to step S2705. In step S2705, the CPU 211 stores (updates) the reading result of the back side into the storage unit 214 in preparation for adjustment processing during printing. In step S2704, if the adjustments are determined to not be made during printing (NO in step S2704), the processing proceeds to step S2706. In step S2706, the CPU 211 transmits the reading result of the back side for normal adjustment processing. FIG. 16B is a flowchart illustrating the adjustment processing during printing. In step 2711, the CPU 211 receives a page processing start instruction from the control unit 110. The page processing start instruction includes a page number, a sheet number, and front side and back side information. In step S2712, the CPU 211 determines whether the print side is the front side. If, in step S2712, the print side is determined to be the front side (YES in step S2712), the processing proceeds to step S2717. In step S2717, the CPU 211 records the sheet number and the adjustment value ID into the table 2500. For example, when performing page processing on the front side of the sheet with the sheet number 8, the CPU 211 stores the current value of the counter for the adjustment value ID into the adjustment value ID field. At this time, a value of "2" is stored into the adjustment value ID field since the counter has been incremented by one.

If the target of the page processing is not the front side but the back side (NO in step S2712), the processing proceeds to step S2713. In step S2713, the CPU 211 refers to the table 2500. In step S2714, the CPU 211 determines whether there is a subsequent sheet registered. If there is a subsequent sheet registered (YES in step S2714), the processing proceeds to step S2715. In step S2715, the CPU 211 determines whether the adjustment value ID corresponding to the next sheet number is different. If the adjustment value ID corresponding to the next sheet number is different (YES in step S2715), the processing proceeds to step S2716. In step S2716, the CPU 211 transmits the reading result of the back side. For example, if a page processing start instruction for the back side of the sheet with the sheet number 7 is received, the next sheet number is the sheet number 8. At this time, the reading result of the back side is transmitted since the adjustment value IDs corresponding to the sheet numbers 7 and 8 are different from each other. In other words, if the next sheet where image formation is to be performed on the back side is the sheet for which the updated adjustment values have been used as the adjustment values for the front side, the CPU 211 determines that the timing to update the adjustment values for the back side has come. If there is no subsequent sheet in step S2714 (NO in step S2714), the processing also proceeds to step S2716, and the CPU 211 transmits the reading result of the back side. Adjustment values based on this reading result correspond to an adjustment value ID of 3. Since there is no subsequent sheet, the adjustment values are not used in the current image formation but can be used in the next image formation. In step S2715, if the adjustment value ID corresponding to the next sheet number is not different (NO in step S2715), the processing ends.

As described above, according to the present exemplary embodiment, in a series of image forming processes, the reading results of the front side and the back side are obtained and then the adjustment values are reflected in the front side and the back side at respective different timings. Thus, the adjustment values based on the reading results obtained at the same timing are applied to the front side and the back side of a sheet. Therefore, appropriate image adjustment values can be reflected in both the front side and the back side regardless of the obtaining timing of the reading results.

In the above-described exemplary embodiments, the adjustment values are described to be set by a method using the operation unit 150. However, the adjustment values may be set by any other method. For example, the setting change may be made using an image processing controller connected to the image forming apparatus. Alternatively, the image forming apparatus may function as a web server and provide a web page to an external apparatus such as a personal computer so that the setting change can be received from the external apparatus running a web browser.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)), a flash memory device, a memory card, and the like.

While the present disclosure has been described with reference to exemplary embodiments, the scope of the following claims are to be accorded the broadest interpretation so as to encompass all such modifications and equivalent structures and functions.

This application claims the benefit of Japanese Patent Applications No. 2021-011287 filed Jan. 27, 2021, No. 2021-011288 filed Jan. 27, 2021, No. 2021-024689 filed Feb. 18, 2021, and No. 2021-168002 filed Oct. 13, 2021, which are hereby incorporated by reference herein in their entirety.

What is claimed is:

1. An image forming system configured to cyclically convey an Nth sheet with an image formed on a first side by an image forming unit to the image forming unit as a sheet to be subjected to image formation after image formation on an (N+i)th sheet subsequent to the Nth sheet, and form an image on a second side of the Nth sheet, the image forming system comprising:

one or more controllers configured to function as:

an obtaining unit configured to, during a series of image forming processes for image formation on a plurality of sheets including the Nth sheet and the (N+i)th sheet, obtain an updated adjustment value for the first side and an updated adjustment value for the second side as adjustment values to be used for image formation; and a control unit configured to control an image processing unit to perform processing so that the updated adjustment value for the first side and an unupdated adjustment value for the second side are simultaneously stored in a storage in a part of a period of the series of image forming processes, form an image on the first side of the (N+i)th sheet by using the updated adjustment value for the first side, and then form the image on the second side of the Nth sheet by using the unupdated adjustment value for the second side.

2. The image forming system according to claim 1, wherein the part of the period is a period from when the updated adjustment values are obtained to when every sheet, among the plurality of sheets, on which an image is formed on the first side by using the updated adjustment value for the first side is cyclically conveyed to the image forming unit.

3. The image forming system according to claim 1, wherein the part of the period is a period up to when an image is formed on the second side of every sheet, among the plurality of sheets, on which an image is formed on the first side by using an unupdated adjustment value for the first side, by using the unupdated adjustment value for the second side.

4. The image forming system according to claim 1, wherein the controllers are further configured to function as a determination unit configured to, in a case where the image is to be formed on the second side of the Nth sheet, determine whether the image is formed on the first side of the Nth sheet by using an unupdated adjustment value for the first side or the updated adjustment value for the first side, and determine whether to use the unupdated adjustment value for the second side or the updated adjustment value for the second side to form the image on the second side of the Nth sheet, based on a result of the determination.

5. The image forming system according to claim 1, wherein the controllers are further configured to function as a determination unit configured to, in case where the image is to be formed on the second side of the Nth sheet, determine whether the image is formed on the first side of the Nth sheet before timing when the updated adjustment values are obtained or after the timing, and determine whether to use the unupdated adjustment value for the second side or the updated adjustment value for the second side to form the image on the second side of the Nth sheet, based on a result of the determination.

6. The image forming system according to claim 1, further comprising a reading unit configured to read a sheet on which image formation is completed by the image forming unit, wherein the controllers are further configured to function as an obtaining unit configured to obtain the updated adjustment values based on a result of the reading by the reading unit during the series of image forming processes.

7. The image forming system according to claim 1, wherein the adjustment values are obtained based on a result of reading a sheet on which an image of a predetermined mark is formed during the series of image forming processes.

8. The image forming system according to claim 7, wherein the sheet on which the image of the predetermined mark is formed is output separately from a product resulting from the series of image forming processes.

9. The image forming system according to claim 7, wherein the image of the predetermined mark is formed on a sheet end of a product resulting from the series of image forming processes.

10. The image forming system according to claim 1, wherein the adjustment values are values for adjusting a position of an image formed on a sheet.

11. The image forming system according to claim 1, wherein the controllers are further configured to function as a control unit configured to control the image forming unit to form an image to which an image position correction is made based on the adjustment values.

12. The image forming system according to claim 1, wherein the controllers are further configured to function as a control unit configured to control the image forming unit to form an image to which a density correction is made based on the adjustment values.

13. The image forming system according to claim 1, wherein the controllers are configured to simultaneously store a smaller number of the adjustment values for the first side and a smaller number of the adjustment values for the second side than a total number of the adjustment values for the first side and a total number of the adjustment values for the second side that are obtained during the series of image forming processes, respectively.

14. The image forming system according to claim 1, wherein the controllers are configured to simultaneously store, as the adjustment values, two adjustment values for the first side and two adjustment values for the second side.

15. A method for controlling an image forming system configured to cyclically convey an Nth sheet with an image formed on a first side by an image forming unit to the image forming unit as a sheet to be subjected to image formation after image formation on an (N+i)th sheet subsequent to the Nth sheet, and form an image on a second side of the Nth sheet, the method comprising:

during a series of image forming processes for image formation on a plurality of sheets including the Nth sheet and the (N+i)th sheet, obtaining an updated adjustment value for the first side and an updated adjustment value for the second side as adjustment values to be used for image formation; and controlling an image processing unit to perform processing so that the updated adjustment value for the first side and an unupdated adjustment value for the second side are simultaneously stored in a storage in a part of a period of the series of image forming processes, form an image on the first side of the (N+i)th sheet by using the updated adjustment value for the first side, and then form the image on the second side of the Nth sheet by using the unupdated adjustment value for the second side.

16. A non-transitory computer-readable storage medium storing a program for causing a computer to perform a method for controlling an image forming system configured to cyclically convey an Nth sheet with an image formed on a first side by an image forming unit to the image forming unit as a sheet to be subjected to image formation after image formation on an (N+i)th sheet subsequent to the Nth sheet, and form an image on a second side of the Nth sheet, the method comprising:

during a series of image forming processes for image formation on a plurality of sheets including the Nth sheet and the (N+i)th sheet, obtaining an updated adjustment value for the first side and an updated adjustment value for the second side as adjustment values to be used for image formation; and controlling an image processing unit to perform processing so that the updated adjustment value for the first side and an unupdated adjustment value for the second side are simultaneously stored in a storage in a part of a period of the series of image forming processes, form an image on the first side of the (N+i)th sheet by using the updated adjustment value for the first side, and then form the image on the second side of the Nth sheet by using the unupdated adjustment value for the second side.

* * * * *